US007312757B2

(12) United States Patent
Watanabe

(10) Patent No.: US 7,312,757 B2
(45) **Date of Patent: *Dec. 25, 2007**

(54) ANTENNA DEVICE, METHOD AND PROGRAM FOR CONTROLLING DIRECTIVITY OF THE ANTENNA DEVICE, AND COMMUNICATIONS APPARATUS

(75) Inventor: Shin Watanabe, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/396,849

(22) Filed: Apr. 3, 2006

(65) Prior Publication Data

US 2006/0181476 A1 Aug. 17, 2006

Related U.S. Application Data

(62) Division of application No. 10/894,984, filed on Jul. 20, 2004, now Pat. No. 7,084,816.

(30) Foreign Application Priority Data

Mar. 11, 2004 (JP) ..... 2004-069516

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS, 846, 848
See application file for complete search history.

(56) References Cited

U.S. PATENT DOCUMENTS 7,202,823 B2 * 4/2007 Watanabe ..... 343/700 MS
2005/0239519 A1 * 10/2005 Saitou et al. ..... 455/575.1

FOREIGN PATENT DOCUMENTS

| | | |
|---|---|---|
| JP | 6-061727 | 3/1994 |
| JP | 8-279771 | 10/1996 |
| JP | 10-190347 | 7/1998 |
| JP | 2001-274616 | 10/2001 |

* cited by examiner

*Primary Examiner*—Hoanganh Le
(74) *Attorney, Agent, or Firm*—Katten Muchin Rosenman LLP

(57) ABSTRACT

The present invention relates to an antenna device and enables the directivity of an antenna element to be changed without affecting the resonance frequency of the antenna element. The antenna device comprises a first grounded conductor, an antenna element mounted on the first grounded conductor via an insulator, a second grounded conductor disposed separate from the first grounded conductor, and a changing unit for changing directivity of the antenna element by adding the second grounded conductor to the first grounded conductor or canceling the addition thereof.

6 Claims, 25 Drawing Sheets

ANTENNA DEVICE, METHOD AND PROGRAM FOR CONTROLLING DIRECTIVITY OF THE ANTENNA DEVICE, AND COMMUNICATIONS APPARATUS

CROSS REFERENCE TO RELATED APPLICATION

This application is a divisional of U.S. application Ser. No. 10/894,984, filed Jul. 20, 2004, now U.S. Pat. No. 7,084,816, and claims priority from Japanese Application 2004-069516 filed Mar. 11, 2004, the contents of which are herein incorporated by reference.

BACKGROUND OF THE INVENTION

1. Field of the Invention

The present invention relates generally to an antenna device using a planar or other antenna, and, more particularly, to an antenna device for changing antenna directivity depending on the inclination of the enclosure, etc. of a radio communications apparatus such as a mobile communications terminal apparatus, as well as to a directivity control method and the communications apparatus.

2. Description of the Related Art

While, among recent mobile communications terminal apparatuses, those incorporating a GPS (Global Positioning System) antenna and GPS receiver and performing positioning by receiving radio wave from GPS satellite have become widespread, performance enhancement of the incorporated antenna is hoped for in order to improve positioning accuracy.

Conventional GPS planar antenna incorporated in a mobile communications terminal apparatus will be described with reference to FIG. 1. A mobile terminal 2, equipped with first and second main body portions 4 and 6, has the main body portions 4 and 6 joined with a hinge portion 8 to allow opening and closing. That is, if the main body portion 4 is a fixed portion, the other main body 6 is a movable portion. There is provided a communications antenna 10 on the side of the main body portion 4, whereas there is provided a GPS planar antenna 12 on the side of the main body portion 6. The planar antenna 12 is mounted on a ground pattern portion 16, a grounded conductor on the surface portion of a printed board 14 incorporated in the main body portion 6. The ground pattern portion 16 is provided on one side of the printed board 14 so as to cover the entire surface thereof. In this case, there is mounted a display device 18 on the rear side of the printed board.

Thus, in the case of the planar antenna 12 provided on the main body portion 6, an antenna radiation pattern 20 is formed having a central axis in the orthogonal direction to the surface of the ground pattern portion 16. Gain is high in the direction shown by an arrow 22 having the antenna radiation pattern 20 at the center, allowing radio wave to be readily radiated. On the other hand, gain tends to be low on the rear side of the planar antenna 12 and on the upper (U) and lower (B) sides of the main body portion 6.

The planar antenna 12 is used in the mobile terminal 2 as GPS receive antenna because GPS radio wave transmitted from satellites is circular polarized—a system difficult to be dependent on antenna reception angle—and circular polarized antenna is advantageous for GPS radio wave reception, allowing the planar antenna 12 to be highly efficient and provide high gain.

However, the circular polarized planar antenna 12 is highly directive with radiation pattern concentrated in a specific direction, resulting in gain in the opposite direction tending to be low. If the planar antenna 12 is provided in the mobile terminal 2 or other, angular change with respect to the incoming direction of radio wave affects positioning accuracy. That is, since the planar antenna 12 is remarkably directive, there are angles in which radio wave is strongly and properly received and those in which radio wave is difficult to receive, resulting in low reception sensitivity and deteriorated positioning accuracy depending on the angle during use.

Among patent documents related to such an antenna are Japanese Patent Application Laid-Open Publication Nos. 08-279711 and 10-190347.

Japanese Patent Application Laid-Open Publication No. 08-279711 discloses an antenna device that requires no vertical plane directivity adjustment by automatically pointing the beam in a specific direction irrespective of the usage condition of the mobile terminal. The antenna device comprises, in an antenna device attached to a mobile terminal, an array antenna attached to the mobile terminal cover, phase shifting means connected to the array antenna for adjusting the antenna beam direction and angle detection means connected to the phase shifting means for detecting the angle formed between the mobile terminal main body and cover and is configured to change the phase shift of the phase shifting means depending on the detection results of the phase detection means so as to adjust the antenna beam to a desired direction.

Japanese Patent Application Laid-Open Publication No. 10-190347 discloses a patch antenna device capable of handling a plurality of frequencies. The patch antenna device has a conductive member on the surface of a dielectric substrate shaped into a basic patch portion and additional patch portions. The anode of a PIN diode is connected to one of the patch portions, whereas the cathode is connected to the other patch portion, thus electrically isolating the patch portions from each other when no control DC voltage is imparted to the diode. When control DC voltage is imparted to the diode such that a forward current flows through the diode, the patch portions are electrically connected, resulting in the effective magnitude of the antenna element becoming f2, lower than a resonance frequency f1 when DC voltage is not imparted and showing that the apparatus can handle two frequencies.

Incidentally, the GPS planar antenna 12, provided in the main body portion 6 of the mobile terminal 2 shown in FIG. 1, has its gain biased in a specific direction. While the receive level of incoming signal from the direction opposite to the arrow 22 is high with high positioning accuracy, the receive level of incoming signal from any other directions—left, upper (U) and lower (B) directions in the figure—is low, with low positioning accuracy. There is a possibility that, if the mobile terminal 2 equipped with such an antenna is put in a chest pocket of the user's clothing with the antenna 10 pointing up in the zenith direction, positioning accuracy may degrade due to low directivity of the planar antenna 12 toward GPS signal arriving from the zenith direction. To properly receive GPS signal from the zenith direction, the planar antenna 12 must be set up in the zenith direction. Thus, relative angular change between the circular polarized planar antenna 12 and a GPS satellite in the zenith direction affects positioning accuracy. GPS radio wave reception is carried out irrespective of the angle of the planar antenna 12, including regular and automatic acquisition of position information and position search for the user carrying a mobile terminal with built-in GPS from other party. For this reason, proper GPS radio wave reception demands that directivity of the planar antenna 12 be pointed toward the incoming direction of GPS radio wave so as not to be dependent on the angle between the mobile terminal 2 and the GPS satellite.

The antenna device disclosed by Japanese Patent Application Laid-Open Publication No. 08-279711, an array antenna provided with a plurality of antenna elements, is configured to vary the phase of a signal powering each element depending on the inclination angle of the mobile terminal cover, thus pointing the antenna directivity toward a given direction through combining of electromagnetic wave radiated from each element. Directivity change requires a phase shifting circuit that combines a plurality of PIN diodes and a delay line. Array antenna has a sharp antenna beam and is suited for a point-to-point communication in which a mobile terminal communicates with another because of strong directivity in a specific direction. Antenna gain is extremely low in directions other than the specific direction in which directivity is concentrated, resulting in low positioning accuracy in the case of GPS satellite radio wave reception using such an antenna with sharp beam for positioning because the antenna receives radio wave only from satellites in the specific direction and thus making the choice of this antenna unfit for GPS radio wave reception.

The patch antenna device disclosed in Japanese Patent Application Laid-Open Publication No. 10-190347 has a basic patch portion and a plurality of additional patch portions formed on the surface portion of the dielectric substrate, with the basic and additional patch portions selectively connected, thus changing the resonance frequency through connection of the additional patch portions. Connection of the additional patch portion to the basic patch portion changes the physical area of the antenna element of the patch antenna, thus providing a plurality of resonance frequencies with a single patch antenna. However, even if addition of the additional patch portion to the basic patch portion changes antenna directivity, this also changes the resonance frequency, thus making the patch antenna unfit for GPS radio wave reception of a specific communication frequency. If the resonance frequency changes, communication becomes impossible, thus making positioning impossible.

Neither Japanese Patent Application Laid-Open Publication No. 08-279711 nor Japanese Patent Application Laid-Open Publication No. 10-190347 describes or suggests a problem of antenna directivity change and control without changing resonance frequencies or means for solving the problem.

SUMMARY OF THE INVENTION

Thus, the present invention relates to an antenna device, and an object thereof is to enable the directivity of an antenna element to be changed without affecting the resonance frequency of the antenna element.

In order to achieve the above object, according to a first aspect of the present invention there is provided an antenna device comprising a first grounded conductor; an antenna element mounted on the first grounded conductor via an insulator; a second grounded conductor disposed separate from the first grounded conductor; and a changing unit which changes directivity of the antenna element by adding the second grounded conductor to the first grounded conductor or canceling the addition thereof. Such a configuration allows the grounded conductor area to change relative to that of an antenna element when a second grounded conductor is added to a first grounded conductor provided with the antenna element, enhancing directivity of the second grounded conductor on the addition side as compared with directivity without addition thereof. That is, this provides directivity appropriate to uneven distribution of the grounded conductors resulting from addition of the second grounded conductor. In this case, the change is limited only to the grounded conductor area, with the antenna element remaining unchanged in area and shape, thus allowing antenna element's directivity to be changed without affecting its resonance frequency.

In order to achieve the above object, according to a second aspect of the present invention there is provided an antenna device comprising a first grounded conductor; an antenna element mounted on the first grounded conductor via an insulator; a plurality of second grounded conductors disposed separate from the first grounded conductor; an inclination detection unit (inclination sensor) which detects an inclination of the antenna element; and a changing unit which changes directivity of the antenna element by adding the second grounded conductor to the first grounded conductor or canceling the addition thereof depending on the inclination detected by the inclination detection unit. Such a configuration allows antenna element's inclination to be detected by an inclination detection unit. Based on the inclination information, connection of the first grounded conductor with the second grounded conductor is selected. As a result, the second grounded conductor is added to the first grounded conductor depending on the inclination of the antenna element, thus changing the grounded conductor area relative to that of the antenna element and enhancing directivity of the second grounded conductor on the addition side. This makes it possible to change antenna element's directivity without affecting its resonance frequency.

In order to achieve the above object, according to a third aspect of the present invention there is provided an antenna device comprising a first grounded conductor; an antenna element mounted on the first grounded conductor via an insulator; a plurality of second grounded conductors disposed separate from the first grounded conductor; an azimuth detection unit (azimuth sensor) which detects azimuth; and a control unit which controls directivity of the antenna element by adding the second grounded conductor to the first grounded conductor or canceling the addition thereof in consideration of information on azimuth detected by the azimuth detection unit. Such a configuration takes into consideration azimuth information as part of directivity change information, thus pointing directivity toward an intended target such as GPS satellite and providing enhanced communication and positioning accuracy.

In order to achieve the above object, according to a fourth aspect of the present invention there is provided a directivity control method for an antenna device, the method comprising the steps of loading inclination information of an antenna element; and changing directivity of the antenna element by adding a second grounded conductor to a first grounded conductor juxtaposed to the antenna element or canceling the addition thereof depending on the loaded inclination information. Such a configuration allows acquisition of antenna element's inclination information and adds the second grounded conductor to the first grounded conductor or cancels addition thereof based on the antenna element's inclination information, thus providing directivity appropriate to antenna element's inclination information and ensuring enhanced radio wave transmission/reception accuracy.

In order to attain the above object, according to a fifth aspect of the present invention there is provided a directivity control method for an antenna device, the method comprising the steps of loading azimuth information; and changing directivity of an antenna element by adding a second grounded conductor to a first grounded conductor juxtaposed to the antenna element or canceling the addition thereof in consideration of the loaded azimuth information.

In order to attain the above object, according to a sixth aspect of the present invention there is provided a directivity control program for an antenna device, the program causing an information processing unit disposed adjacent to an antenna device to execute the steps of loading inclination information of an antenna element; and changing directivity of the antenna element by adding a second grounded conductor to a first grounded conductor juxtaposed to the antenna element or canceling the addition thereof depending on the loaded inclination information. Such a configuration allows acquisition of antenna element's inclination information and adds the second grounded conductor to the first grounded conductor or cancels addition thereof based on the antenna element's inclination information, thus providing directivity appropriate to antenna element's inclination information and ensuring enhanced radio wave transmission/reception accuracy.

In order to accomplish the above object, according to a seventh aspect of the present invention there is provided a directivity control program for an antenna device, the program causing an information processing unit disposed adjacent to an antenna device to execute the steps of loading azimuth information; and changing directivity of the antenna element by adding a second grounded conductor to a first grounded conductor juxtaposed to the antenna element or canceling the addition thereof in consideration of the loaded azimuth information.

In order to accomplish the above object, a communications apparatus of the present invention is mounted with the antenna device such that its antenna directivity is changeable. Such a configuration allows the optimal antenna directivity to be set depending on antenna element's inclination, thus improving communications reliability and contributing to improved positioning accuracy, for example, as a result of enhanced GPS radio wave reception strength.

Features and advantages of the present invention are listed hereinbelow.

(1) According to the antenna device of the present invention, whether a second grounded conductor is added to a first grounded conductor provided with antenna element changes the grounded conductor area relative to that of antenna element and unevenly distributes the grounded conductors, thus changing antenna element's directivity and keeping antenna element's resonance frequency unchanged because of directivity change through uneven distribution of the grounded conductors alone.

(2) According to the directivity control method or program of the antenna device of the present invention, it is possible to point antenna directivity toward a radio wave arrival or propagation direction depending on inclination angle without changing antenna element's resonance frequency, thus contributing to improved communications reliability.

(3) According to the communications apparatus of the present invention, it is possible to point antenna directivity toward a radio wave arrival or propagation direction, thus providing enhanced communications reliability and enhanced positioning accuracy in GPS radio wave reception.

(4) As described above, the present invention is useful in that it is capable of pointing directivity toward an intended communications direction by changing antenna directivity in consideration of inclination angle and azimuth information, thus providing enhanced communications accuracy.

BRIEF DESCRIPTION OF THE DRAWINGS

The above and other objects, aspects, features and advantages of the present invention will become more apparent from the following detailed description when taken in conjunction with the accompanying drawings, in which.

DETAILED DESCRIPTION OF THE PREFERRED EMBODIMENTS

First Embodiment

Figure 1:
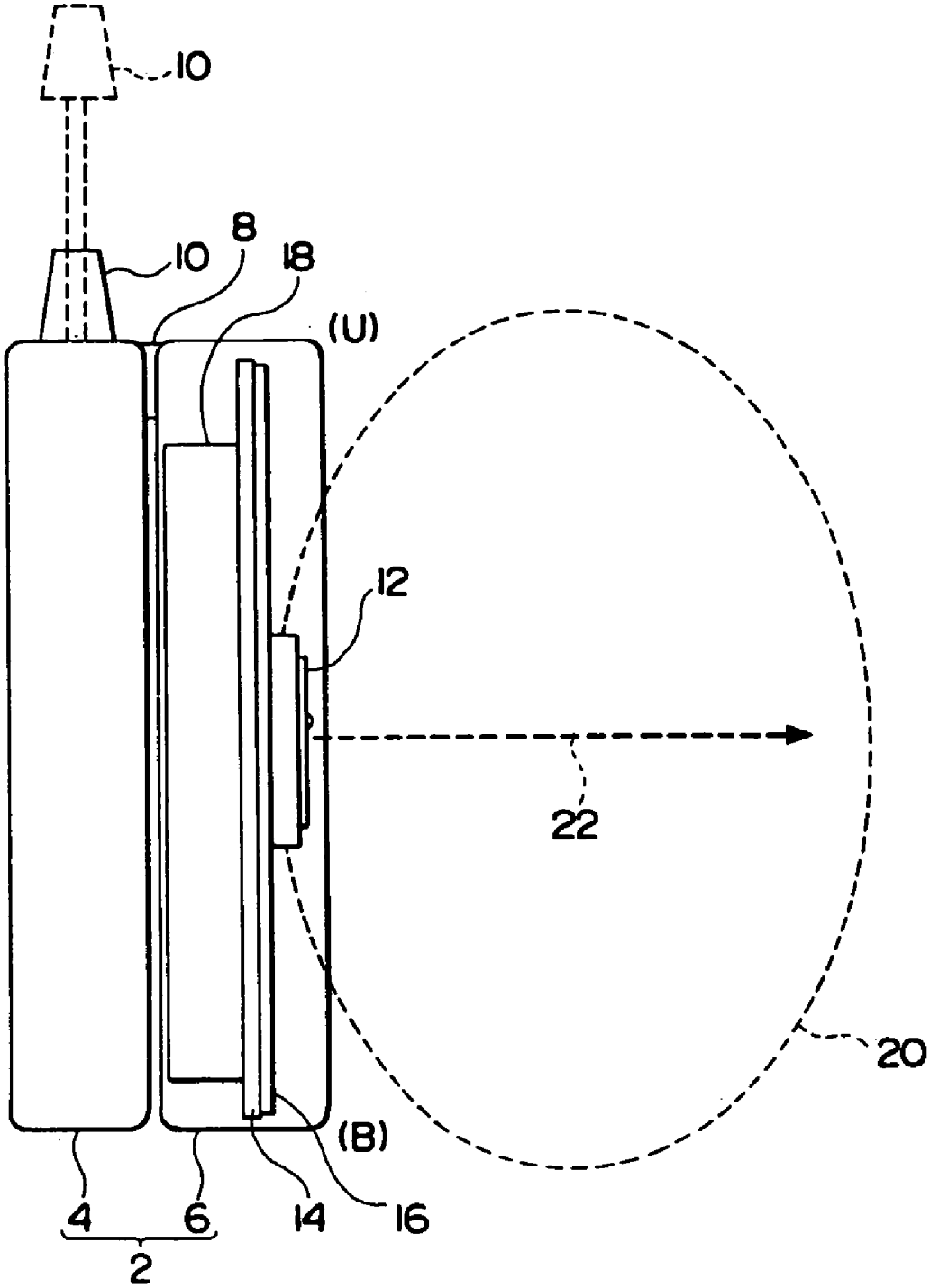
FIG. 1 is a view showing a conventional mobile terminal equipped with a GPS antenna.
Figure 2:
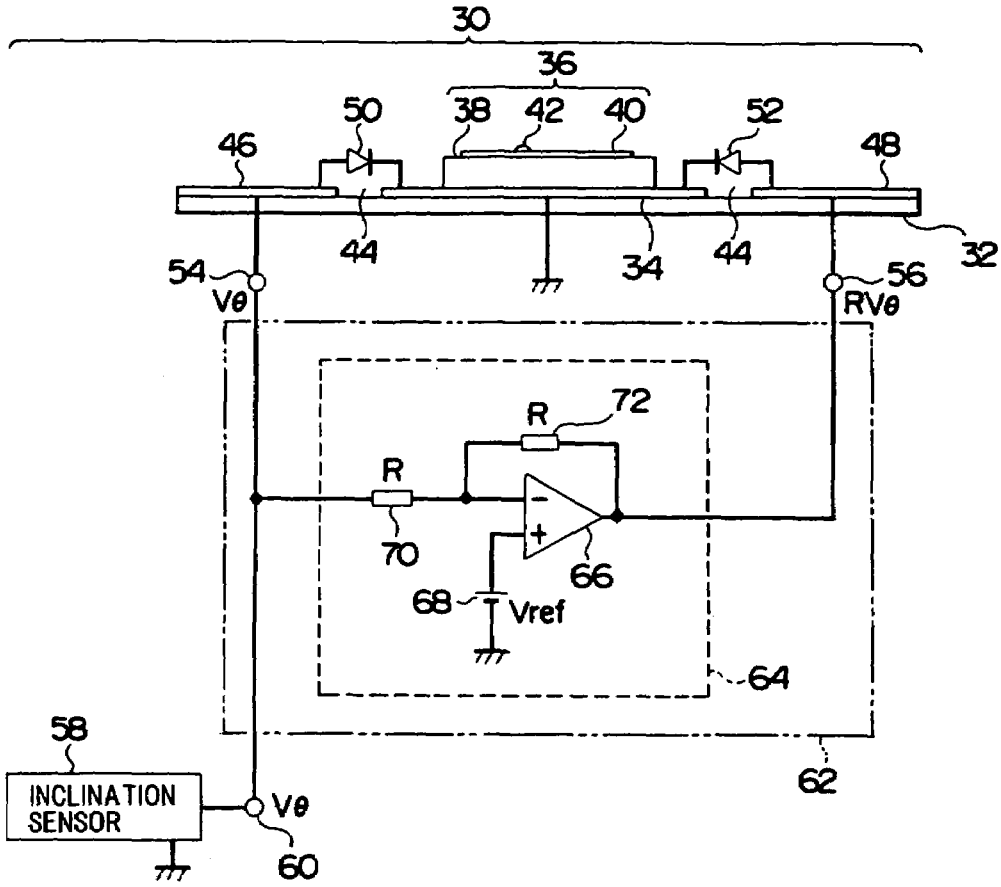
FIG. 2 is a view showing an antenna device according to a first embodiment of the present invention.
Figure 3:
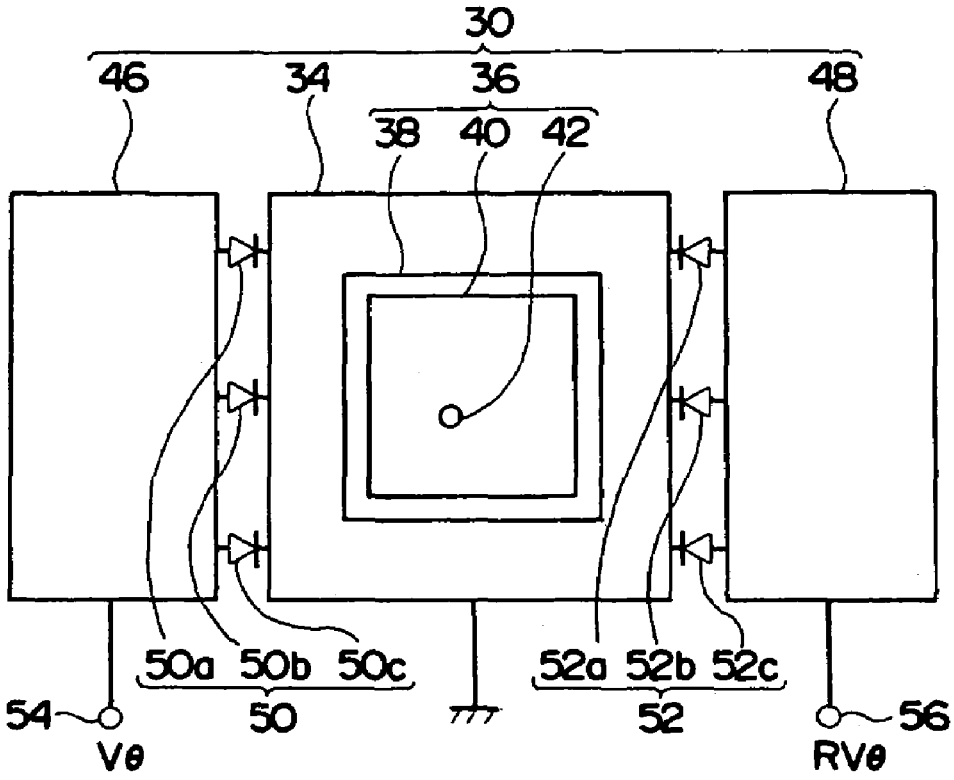
FIG. 3 is a plan view showing a planar antenna in an antenna device.

A first embodiment of the present invention will be described with reference to FIGS. 2 and 3. FIG. 2 is a principle diagram of an antenna device according to a first embodiment of the present invention, whereas FIG. 3 is a view showing a plan view of a planar antenna of the antenna device.

An antenna device 30 is equipped with a printed board 32, and a square ground (GND) pattern portion 34 is, for example, provided as a first grounded conductor on the upper surface of the printed board 32. The GND pattern portion 34 makes up a patch or other antenna mounting portion, and there is installed a planar antenna 36 as antenna element in this embodiment.

The planar antenna 36 is equipped with a dielectric substrate 38, an antenna pattern portion 40, a power supply portion 42 and so on. The dielectric substrate 38 is a similar figure of the GND pattern portion 34, with its vertical projection area being narrower than the GND pattern portion 34 and part of the GND pattern portion 34 exposed at the circumferential portion of the dielectric substrate 38. On the upper surface of the dielectric substrate 38, there is formed the antenna pattern portion 40, a similar figure of the dielectric substrate 38 and narrower than the area of the upper surface of the dielectric substrate 38, through vacuum deposition of a conductive metal such as silver or printing. A relay conductor penetrating the dielectric substrate 38 is electrically connected between the power supply portion 42 and the printed board 32.

In this embodiment, there are provided on the upper surface of the printed board 32 first and second auxiliary rectangular GND pattern portions 46 and 48, having the same length as one side length of the GND pattern portion 34, for example, as a plurality of second grounded conductors at constant spacings 44 for isolation from the GND pattern portion 34 such that the GND pattern portion 34 is sandwiched between the first and second auxiliary GND pattern portions 46 and 48.

There is connected a first PIN diode 50 as a changing unit or switch between the GND pattern portion 34 and the auxiliary GND pattern portion 46, and there is connected a second PIN diode 52 as a changing unit or switch between the GND pattern portion 34 and the auxiliary GND pattern portion 48, with the anodes on the side of the second auxiliary GND pattern portions 46 and 48 and the cathodes on the side of the GND pattern portion 34. In this embodiment, the PIN diodes 50 and 52 respectively consist of three PIN diodes 50*a*, 50*b* and 50*c* and three PIN diodes 52*a*, 52*b* and 52*c*, with the PIN diodes provided at spacings along the widths of the GND pattern portion 34 and the auxiliary GND pattern portions 46 and 48 and with these diodes making up parallel circuits to reduce conduction resistance during conduction. The GND pattern portion 34 is grounded, whereas the auxiliary GND pattern portions 46 and 48 are provided with control terminals 54 and 56. When the PIN diode 50 is caused to conduct as the side of the control terminal 54 is brought to a higher potential, the GND pattern portion 34 and the auxiliary GND pattern portion 46 are brought into conduction via the conducting PIN diode 50. When the PIN diode 52 is caused to conduct as the side of the control terminal 56 is brought to a higher potential, the GND pattern portion 34 and the auxiliary GND pattern portion 48 are brought into conduction via the conducting PIN diode 52.

In the antenna device 30, there is installed an inclination sensor 58 as an inclination detection unit for detecting the inclination angle of the planar antenna 36. If we suppose that the inclination sensor 58 is installed with respect to the vertical direction (center of the antenna radiation pattern) orthogonal to the antenna pattern portion 40 of the planar antenna 36, the inclination sensor 58 detects an inclination angle θ of the planar antenna 36 relative to that direction and outputs an output signal Vθ appropriate to the angle θ from an output terminal 60. The output signal Vθ is applied to a directivity changing unit 62 for changing directivity of the planar antenna 36 as directivity change information. In this embodiment, the output signal Vθ is applied to the control terminal 54 and to a voltage inverting amplifier 64 as a signal inverting unit, thus forming an inverted output signal RVθ and applying the inverted output signal RVθ to the control terminal 56.

The voltage inverting amplifier 64 may be configured in any manner as long as the amplifier forms an inverted signal of the output signal Vθ. In this case, an operational amplifier 66 is used with a reference voltage source 68 connected to the positive input terminal (+) of the operational amplifier 66 and a reference voltage $V_{ref}$ applied. The output signal Vθ is applied to the inverted input terminal (−) via a resistor 70, with the output signal of the operational amplifier 66 fed back via a resistor 72. The resistance values of the resistors 70 and 72 are set, for example, to the same value (R), whereas the one-half level of the output signal Vθ is set to the reference voltage $V_{ref}$ (=Vθ/2).

Such a configuration allows switching to three intervals; an interval in which both the auxiliary GND pattern portions 46 and 48 are added to the GND pattern portion 34 as a result of conduction of the PIN diodes 50 and 52 depending on the level of the output signal Vθ of the inclination sensor 58, another interval in which the auxiliary GND pattern portion 46 is added to the GND pattern portion 34 and addition of the auxiliary GND pattern portion 48 to the GND pattern portion 34 is canceled as a result of conduction of the PIN diode 50 and non-conduction of the PIN diode 52 and still another interval in which addition of the auxiliary GND pattern portion 46 to the GND pattern portion 34 is canceled and the auxiliary GND pattern portion 48 is added to the GND pattern portion 34 as a result of non-conduction of the PIN diode 50 and conduction of the PIN diode 52, thus making it possible to change directivity of the planar antenna 36 through uneven distribution of the grounded conductors.

Figure 4:
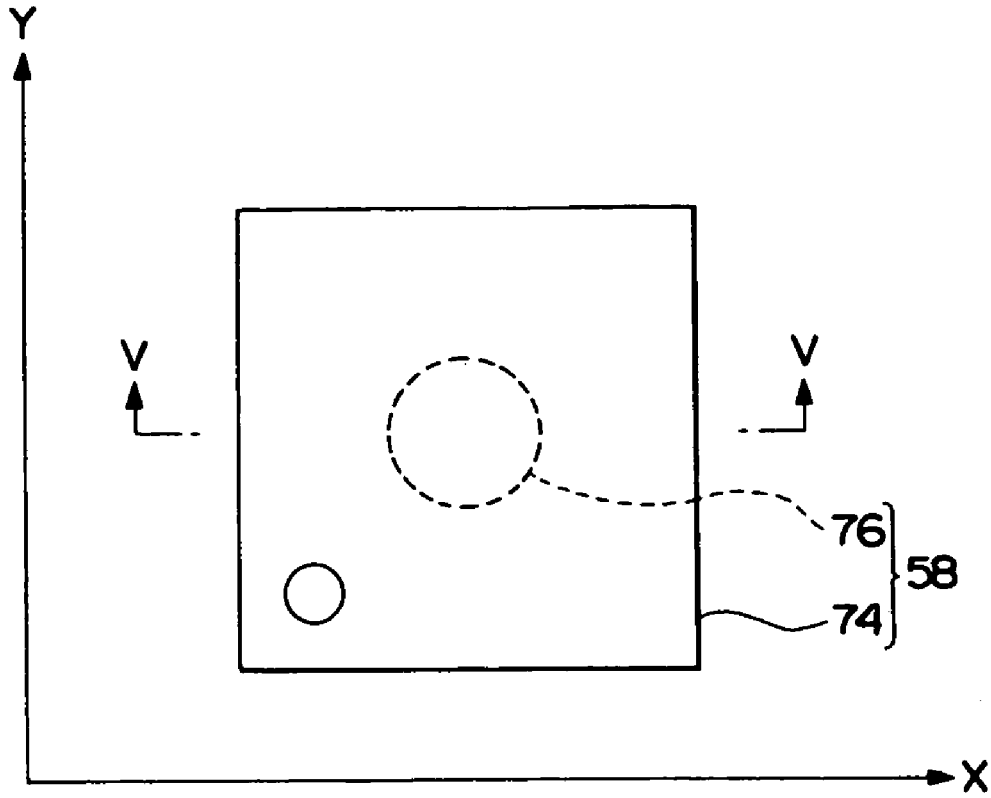
FIG. 4 is a view showing an inclination sensor.
Figure 5:
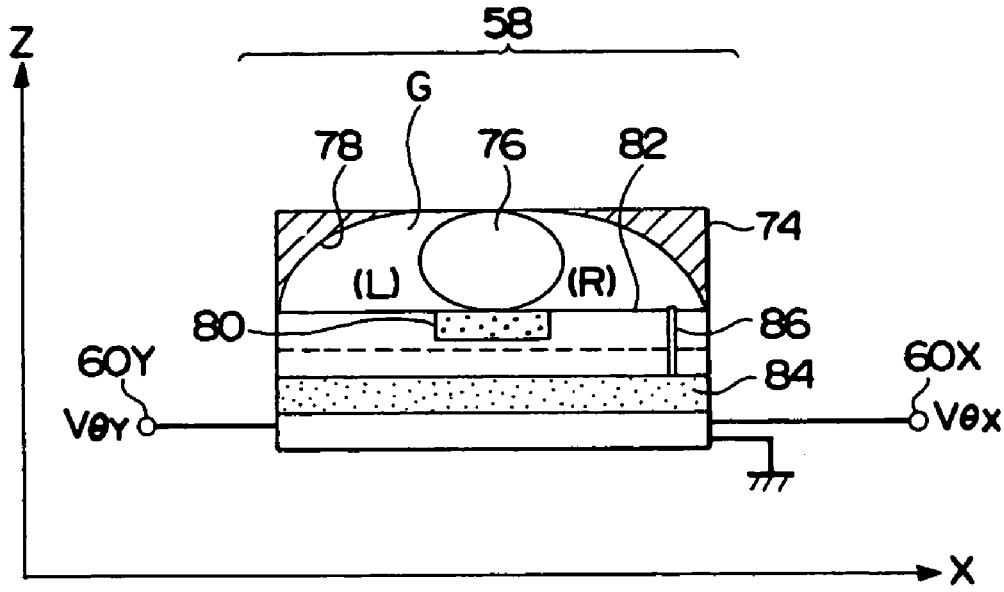
FIG. 5 is a view outlining the cross-section taken along line V-V in FIG. 4.
Figure 6:
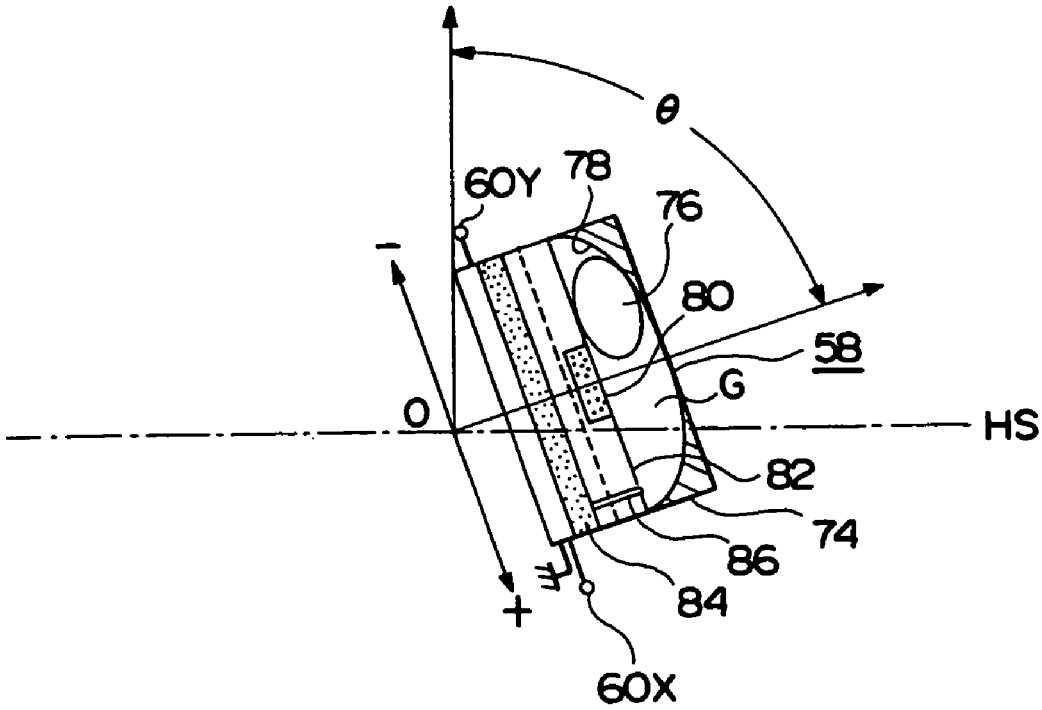
FIG. 6 is a view showing the detection principle of inclination angle of the inclination sensor.
Figure 7:
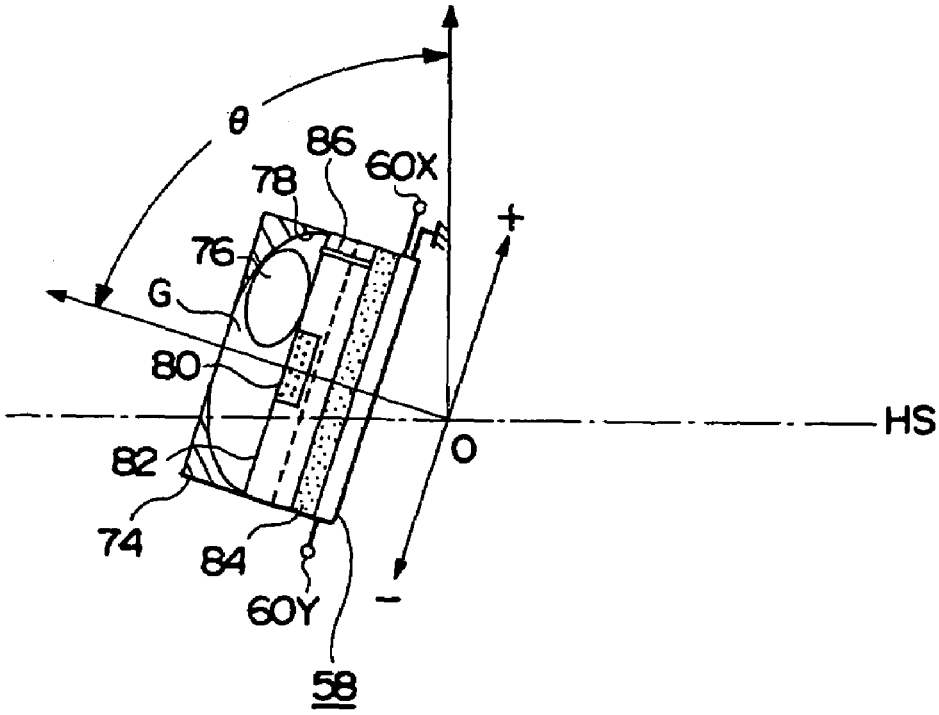
FIG. 7 is a view showing the detection principle of inclination angle of the inclination sensor.
Figure 8:
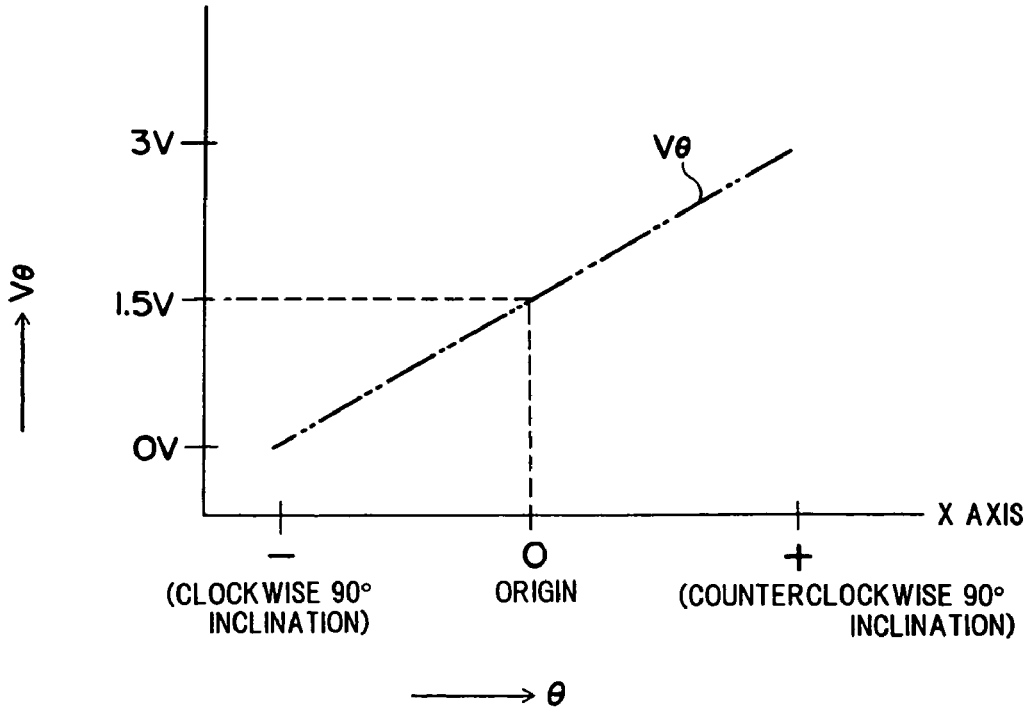
FIG. 8 is a view showing an output signal of the inclination sensor in response to inclination angle.

Next, the inclination sensor 58, an example of the inclination detection unit, will be described with reference to FIGS. 4 to 8. FIG. 4 is a plan view showing the inclination sensor 58, and FIG. 5 is a view outlining the cross-section taken along line V-V in FIG. 4. FIGS. 6 and 7 are views showing the inclination detecting operation of the inclination sensor 58, and FIG. 8 is a view showing the output of the inclination sensor 58.

In FIG. 4, X and Y are X and Y axes developed on a plane. The inclination sensor 58 is, for example, a device equipped with a square enclosure 74, with 76 representing an elliptic-spherical high-temperature gas body formed depending on inclination angle.

The enclosure 74 of the inclination sensor 58 is provided with a semispherical air chamber 78 as shown in FIG. 5 with air and a gas G with high thermal conductivity sealed in the air chamber 78. There are provided a heater 80, a temperature sensor 82, a sensor circuit 84, etc. on the bottom side of the air chamber 78. The heater 80 liberates heat as a result of external application of voltage, heating the gas G in air in the air chamber 78 and generating the high-temperature gas body 76. The temperature sensor 82 covers the entire floor surface side of the air chamber 78 and detects the temperature of the contact portion of the high-temperature gas body 76. The temperature sensor 82 and the sensor circuit 84 are connected via a connection line 86 so that the sensor circuit 84 receives a detection output of the temperature sensor 82 via the connection line 86.

In this case, the high-temperature gas body 76 exists at the central portion in the X and Y directions, with the center portion temperature on the rise. The temperature sensor 82 distributed in the X and Y directions senses that the temperature of the center portion is high, and this information is transmitted to the sensor circuit 84 via the connection line 86 as the position in the X and Y directions, thus allowing the position of the high-temperature gas body 76 to be detected with the sensor circuit 84. The high-temperature gas body 76 is lighter than air, resulting in the gas body 76 rising and moving within the air chamber 78 and moving to a position appropriate to the inclination angle of the enclosure 74. This allows detection of the position of the center portion of the high-temperature gas body 76 in the directions of the X and Y axes based on the temperature at the position in contact with the temperature sensor 82, with an output signal Vθx representing its position on the X axis obtained from an output terminal 60X and an output signal Vθy representing its position on the Y axis obtained from an output terminal 60Y. In FIG. 5, Z represents the Z axis orthogonal to the directions of the X and Y axes. In the first embodiment, the output signal Vθx obtained from the inclination sensor 58 is used and termed an output signal Vθ for description simplicity. In this case, the output signal Vθy may be used as the output signal Vθ.

For instance, when the inclination sensor 58 inclines clockwise by the inclination angle θ relative to a horizontal surface HS as shown in FIG. 6, the high-temperature gas body 76 rises as it moves within the air chamber 78, eventually moving to the upper portion of the inclined air chamber 78. When the inclination sensor 58 inclines counterclockwise by the inclination angle θ relative to the horizontal surface HS as shown in FIG. 7, the high-temperature gas body 76 rises as it moves within the air chamber 78, eventually moving to the upper portion of the inclined air chamber 78. In this case, as a result of inclination of the inclination sensor 58, the temperature of the position in contact with the moved high-temperature gas body 76 is sensed by the temperature sensor 82, thus resulting in the sensing position being detected as the inclination angle θ. In the condition shown in FIG. 6, temperature increase is detected by an L portion (FIG. 5) of the temperature sensor 82 in the negative direction relative to a reference point 0, allowing the sensor circuit 84 to detect that the high-temperature gas body 76 has moved in the negative direction along the X axis. In the condition shown in FIG. 7, temperature increase is detected by an R portion (FIG. 5) of the temperature sensor 82 in the positive direction relative to the reference point 0, allowing the sensor circuit 84 to detect that the high-temperature gas body 76 has moved in the positive direction along the X axis. These outputs of the L and R portions of the temperature sensor 82—the outputs representing the position of the high-temperature gas body 76 on the X and Y axes—are extracted by the sensor circuit 84 as the inclination angle θ from the output terminal 60X on the X axis side and the output terminal 60Y on the Y axis side. That is, the output level thereof represents the magnitude of the inclination angle θ.

If the angle (FIG. 5) of the inclination sensor 58, installed parallel with the horizontal surface HS, is taken as an origin (θ=0), the output Vθ occurring at the output terminal 60X on the X axis side of the inclination sensor 58 has a level appropriate to the inclination angle θ as shown in FIG. 8, increasing or decreasing linearly relative to the origin 0 at the center. In this embodiment, the output voltage (Vθ) is obtained in the range, for example, from 0 [V] as the output voltage representing a 90° clockwise inclination, for example, to 3 [V] as the output voltage representing a 90° counterclockwise inclination, with the intermediate output voltage—the voltage representing the horizontal state of the reference position of the origin 0—set to 1.5 [V]. Such an output form is also true with the Y axis side, and the similar output voltage (Vθ) is obtained from the output terminal 60Y on the Y axis side.

Using the inclination sensor 58, the output signal Vθx is obtained that represents the inclination angle θ from the output terminal 60X on the X axis side, making it possible to use the output signal Vθx as directivity change control information representing the inclination angle θ. The output signal Vθy is obtained that represents the inclination angle θ from the output terminal 60Y on the Y axis side, and this signal may be used as directivity change control information.

Figure 9:
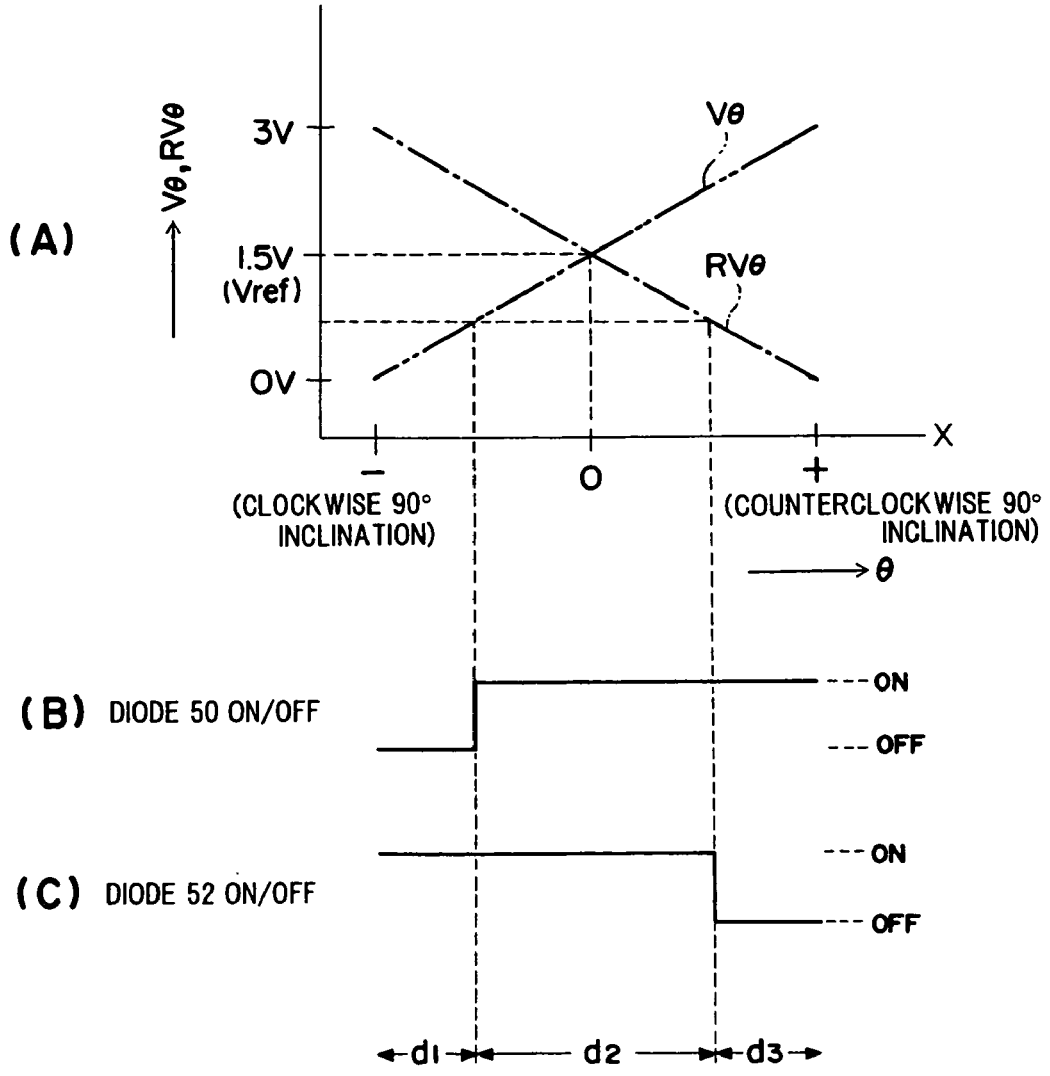
FIG. 9 is a view showing a directivity changing operation of the antenna device.
Figure 10:
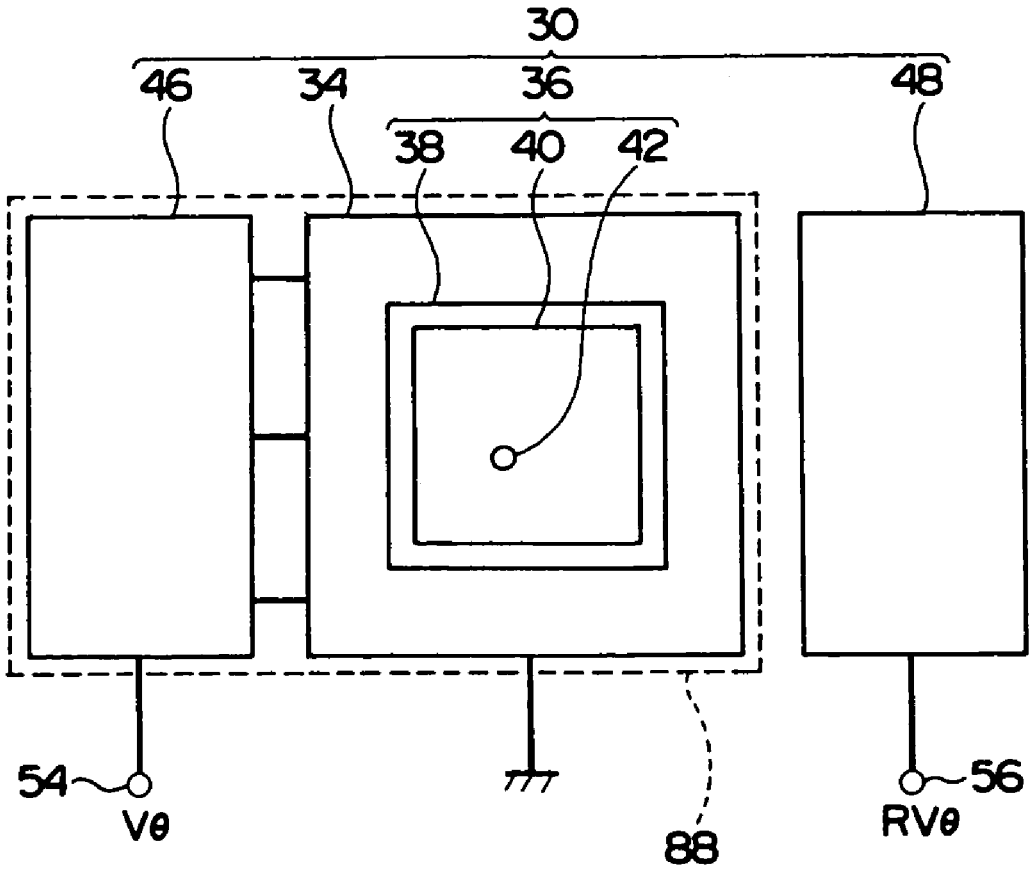
FIG. 10 is a view showing uneven distribution of grounded conductors of the antenna device.
Figure 11:
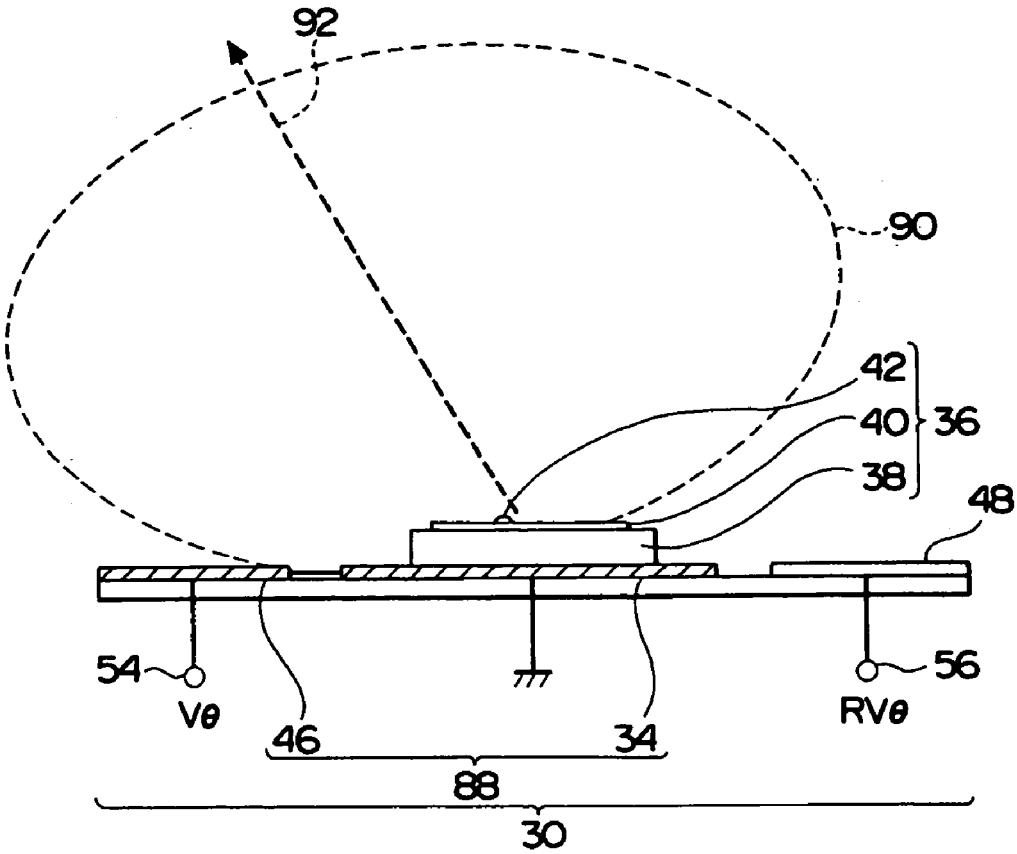
FIG. 11 is a view showing radiation pattern and directivity variations of the antenna device.
Figure 12:
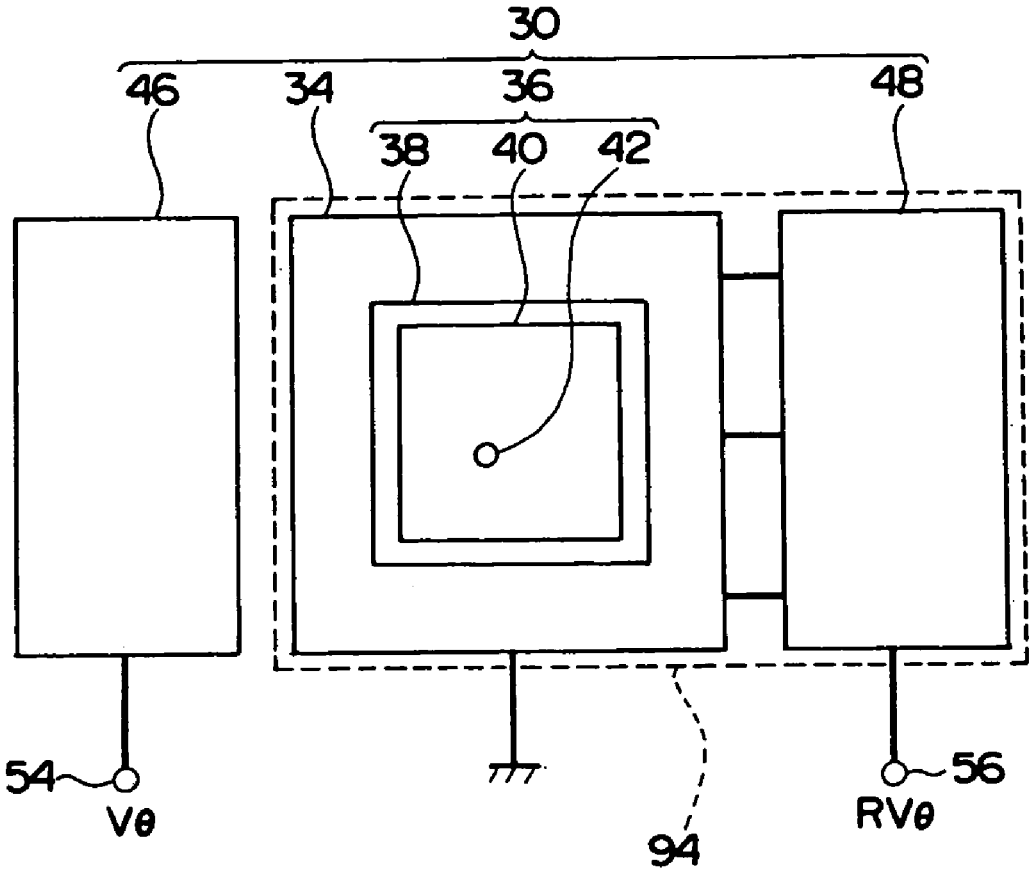
FIG. 12 is a view showing uneven distribution of grounded conductors of the antenna device.
Figure 13:
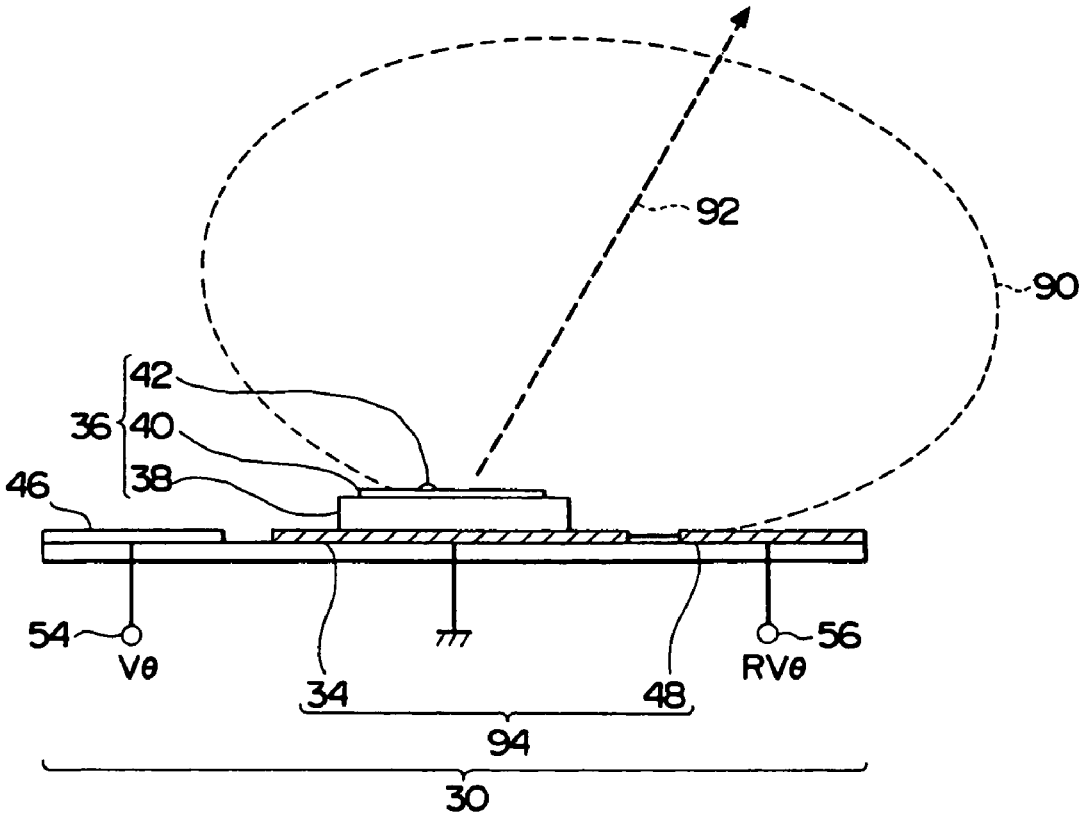
FIG. 13 is a view showing radiation pattern and directivity variations of the antenna device.

Next, the directivity change operation using the output of the inclination sensor 58 will be described with reference to FIG. 9 to 13. FIG. 9 is timing charts showing the operation of the directivity changing unit using the output signals of the inclination sensor 58, FIG. 10 is a view showing connection operation of grounded conductors, FIG. 11 is a view showing how directivity is changed depending on the inclination angle, FIG. 12 is a view showing connection operation of grounded conductors, and FIG. 13 is a view showing how directivity is changed depending on the inclination angle.

As shown in FIG. 9(A), the output signal RVθ of the voltage inverting amplifier 64 is obtained in response to the output signal Vθ of the inclination sensor 58, making the output signals Vθ and RVθ invertedly related with each other relative to the reference voltage $V_{ref}$ at the center. While, as described earlier, the output signal Vθ of the inclination sensor 58 is, for example, 0 [V] as the output voltage representing the clockwise 90° position and 3 [V] as the output voltage representing the counterclockwise 90° position, the output signal RVθ of the voltage inverting amplifier 64 is 3 [V] at the clockwise 90° position and 0 [V] at the counterclockwise 90° position, providing a voltage value appropriate to the inclination angle θ in the range of the inclination angle θ from clockwise to counterclockwise direction.

For this reason, if the inclination angle θ of the inclination sensor 58 is varied from the counterclockwise 90° position to the counterclockwise 90° position, the output signal Vθ of the inclination sensor 58 gradually increases from 0 [V], lifting the potential of the auxiliary GND pattern portion 46. When this potential exceeds a forward drop voltage $V_F$ of the PIN diode 50, the PIN diode 50 conducts, adding the auxiliary GND pattern portion 46 to the GND pattern portion 34 via the conducting PIN diode 50. This addition period is the conduction interval ($d_2$, $d_3$) of the PIN diode 50 shown in FIG. 9(B).

If the inclination angle θ of the inclination sensor 58 is varied from the counterclockwise 90° position to the counterclockwise 90° position, the output signal Vθ of the inclination sensor 58 gradually decreases from 3 [V]. The inverted output signal RVθ obtained from the voltage inverting amplifier 64 gradually increases from 0 [V], lifting the potential of the auxiliary GND pattern portion 48. When this potential exceeds the forward drop voltage $V_F$ of the PIN diode 52, the PIN diode 52 conducts, adding the auxiliary GND pattern portion 48 to the GND pattern portion 34 via the conducting PIN diode 52. This addition period is the conduction interval ($d_1$, $d_2$) of the PIN diode 52 shown in FIG. 9(C). It is to be noted that conduction (ON) of the PIN diode 50 or 52 means a reduced resistance value between the anode and cathode and shut-off state (OFF) means an increased resistance value between the anode and cathode.

As for the conduction intervals of the PIN diodes 50 and 52, the PIN diode 50 is not conducting and the PIN diode 52 is conducting in $d_1$. Both the PIN diodes 50 and 52 are conducting in $d_2$. The PIN diode 50 is conducting and the PIN diode 52 is not conducting in $d_3$.

As a result, the grounded conductors change in the conduction intervals $d_1$, $d_2$ and $d_3$ are as follows.

Conduction interval $d_1$ (conduction of only the PIN diode 52): GND pattern portion 34+auxiliary GND pattern portion 48=grounded conductor 94 (FIGS. 12 and 13)

Conduction interval $d_2$ (conduction of both the PIN diodes 50 and 52): GND pattern portion 34+auxiliary GND pattern portions 46 and 48

Conduction interval $d_3$ (conduction of only the PIN diode 50): GND pattern portion 34+auxiliary GND pattern portion 46=grounded conductor 88 (FIGS. 10 and 11)

In the conduction interval $d_3$ in which only the PIN diode 50 conducts, the auxiliary GND pattern portion 46 is added to the GND pattern portion 34 by the conducting PIN diode 50 as shown in FIG. 10, leaving the auxiliary GND pattern portion 48 on the side of the non-conducting PIN diode 52 unfunctional as a grounded conductor. As a result, the grounded conductor 88 is unevenly distributed because of combining of the GND pattern portion 34 and the auxiliary GND pattern portion 46, tilting the antenna radiation pattern 90 of the planar antenna 36 toward the side of the auxiliary GND pattern portion 46 as shown in FIG. 11 and resulting in tilted directivity as shown by an arrow 92. In the conduction interval $d_1$ in which only the PIN diode 52 conducts, the auxiliary GND pattern portion 48 is added to the GND pattern portion 34 by the conducting PIN diode 52 as shown in FIG. 12. The auxiliary GND pattern portion 46 on the side of the non-conducting PIN diode 50 is unfunctional as a grounded conductor. As a result, the grounded conductor 94 is unevenly distributed because of combining of the GND pattern portion 34 and the auxiliary GND pattern portion 48, tilting the antenna radiation pattern 90 of the planar antenna 36 toward the side of the auxiliary GND pattern portion 48 as shown in FIG. 13 and resulting in tilted directivity as shown by the arrow 92.

Incidentally, the planar antenna 36 installed on the GND pattern portion 34 provides antenna radiation characteristic, and the antenna pattern portion 40 on top of the dielectric substrate 38 makes up, together with the surface portion of the GND pattern portion 34 constituting a parallel surface, an antenna element that resonates at a given frequency. The resonance frequency of the planar antenna 36 is determined by the dielectric constant of a dielectric substance making up the dielectric substrate 38, the size of the antenna pattern portion 40 and the spacing between the antenna pattern portion 40 and the GND pattern portion 34, with antenna directivity varying depending on the size of the grounded conductor such as the GND pattern portion 34 relative to the antenna pattern portion 40 and the direction of expansion. As shown in FIGS. 10 and 11, therefore, if the grounded conductor 88 becomes unevenly distributed, the electric field component of electromagnetic wave, radiated from or received by the antenna pattern portion 40 of the planar antenna 36, is drawn to the grounded conductor 88, tilting an antenna radiation pattern 90 in the direction of uneven distribution of the grounded conductor 88. As shown in FIGS. 12 and 13, if the grounded conductor 94 becomes unevenly distributed, the electric field component of electromagnetic wave, radiated from or received by the antenna pattern portion 40 of the planar antenna 36, is drawn to the grounded conductor 94, tilting the antenna radiation pattern 90 in the direction of uneven distribution of the grounded conductor 94.

In this embodiment, in the conduction interval $d_2$ in which both the PIN diodes 50 and 52 conduct, both the auxiliary GND pattern portions 46 and 48 are added to the GND pattern portion 34 by the conducting PIN diodes 50 and 52. Because of combining thereof, the grounded conductors are symmetrical with the GND pattern portion 34 located at the center, placing directivity of the planar antenna 36 at the reference position.

Thus, when the inclination angle θ of the planar antenna 36 by the inclination sensor 58 reaches a given angle such as ±90° in the clockwise or counterclockwise direction, the PIN diode 50 or 52 selectively conducts or shuts off, adding the auxiliary GND pattern portion 46 or 48 to the GND pattern portion 34 or canceling the addition thereof. This varies the grounded conductor area relative to the planar antenna 36, changing directivity of the planar antenna 36 depending on the inclination angle θ due to uneven distribution of the grounded conductor.

Second Embodiment

Figure 14:
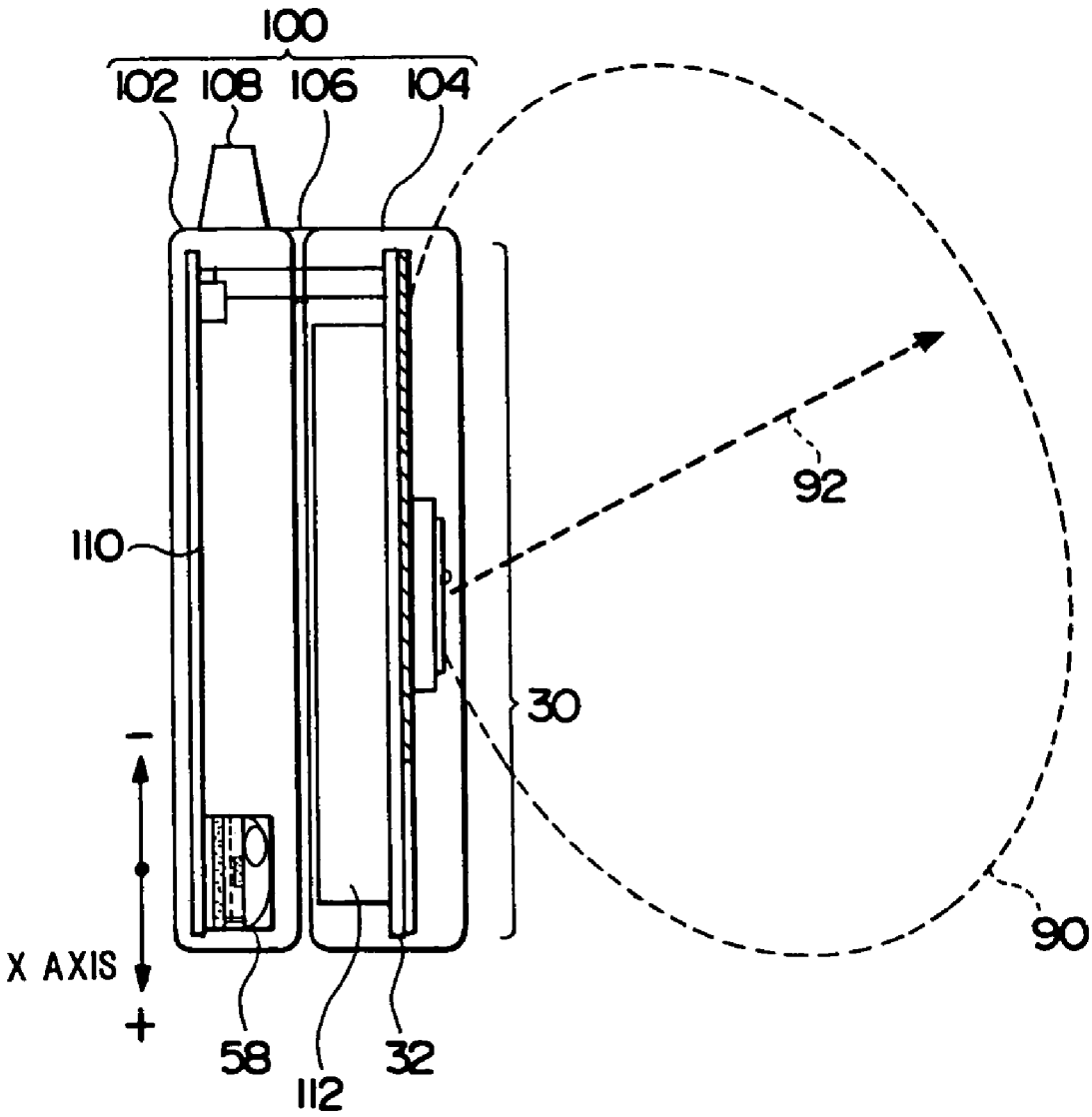
FIG. 14 is a view showing directivity of a mobile terminal according to a second embodiment of the present invention.
Figure 15:
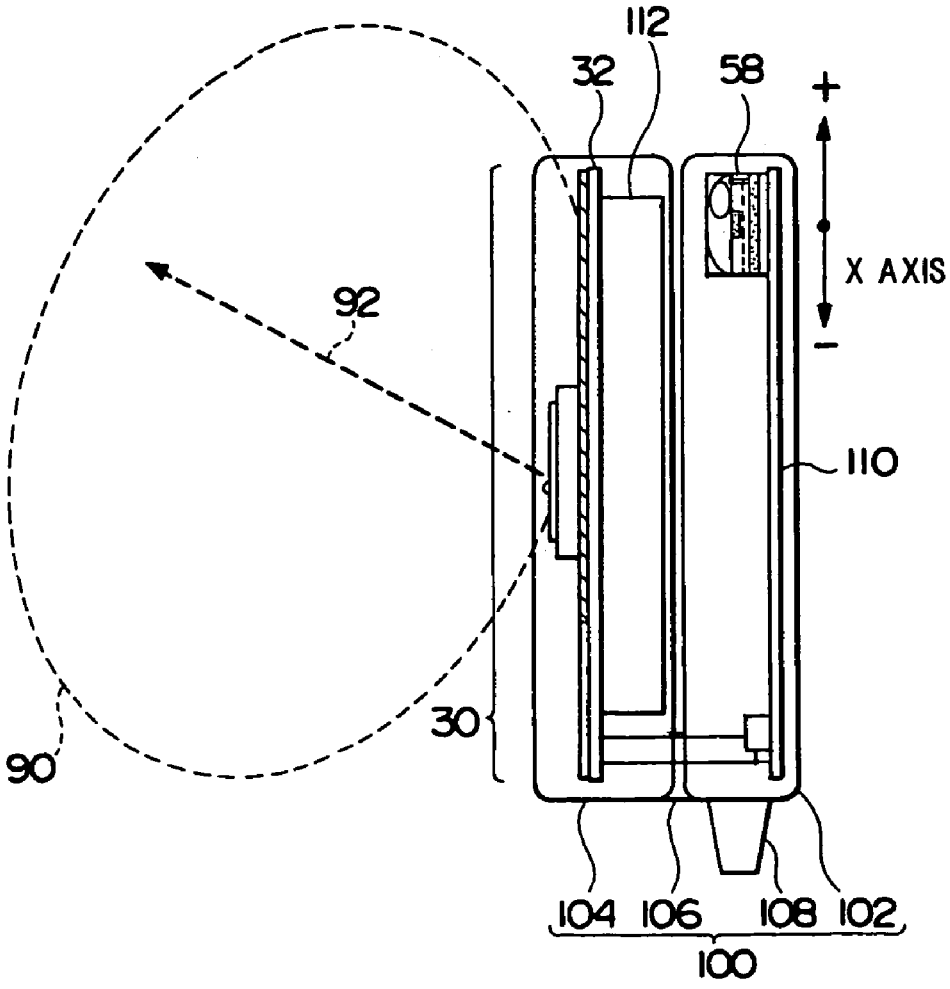
FIG. 15 is a view showing directivity of the mobile terminal.

A second embodiment of the present invention will be described with reference to FIGS. 14 and 15. FIGS. 14 and 15 relate to a mobile terminal, an embodiment of the communications apparatus of the present invention, showing the conditions in which antenna directivity is changed depending on the inclination angle of the mobile terminal.

A mobile terminal 100, equipped with first and second main body portions 102 and 104, has the main body portions 102 and 104 joined with a hinge portion 106 to allow opening and closing. There is provided a communications antenna 108 on the main body portion 102, whereas there is provided the antenna device 30 on the side of the main body portion 104. The antenna device 30 comprises the printed board 32, the GND pattern portion 34, the planar antenna 36, the auxiliary GND pattern portions 46 and 48, etc. described earlier (FIG. 2 and so on). In this embodiment, the inclination sensor 58 is installed on a substrate 110 that is mounted on the side of the main body portion 102, with the output signal Vθ of the inclination sensor 58 applied to the directivity changing unit 62 (FIG. 2) of the antenna device 30. There is mounted a display device 112 on the rear side of the printed board 32.

If the mobile terminal 100 is put in a chest pocket of the user's clothing and maintained in an upright condition with the side of the communications antenna 108 facing upward, for example, as shown in FIG. 14, the inclination angle θ is detected to be clockwise 90° by the inclination sensor 58, resulting in the conduction interval ($d_3$) in which only the PIN diode 50 conducts. As a result, the radiation pattern 90 of the antenna device 30 tilts to the zenith direction, pointing its directivity in the direction shown by the arrow 92. In this case, directivity points in the negative X-axis direction.

If the mobile terminal 100 is maintained in an upright condition with the side of the communications antenna 108 facing downward, for example, as shown in FIG. 15, the inclination angle θ is detected to be counterclockwise 90° by the inclination sensor 58, resulting in the conduction interval ($d_1$) in which only the PIN diode 52 conducts. As a result, the radiation pattern 90 of the antenna device 30 similarly tilts to the zenith direction, pointing its directivity in the direction shown by the arrow 92. In this case, directivity points in the positive X-axis direction.

Figure 16:
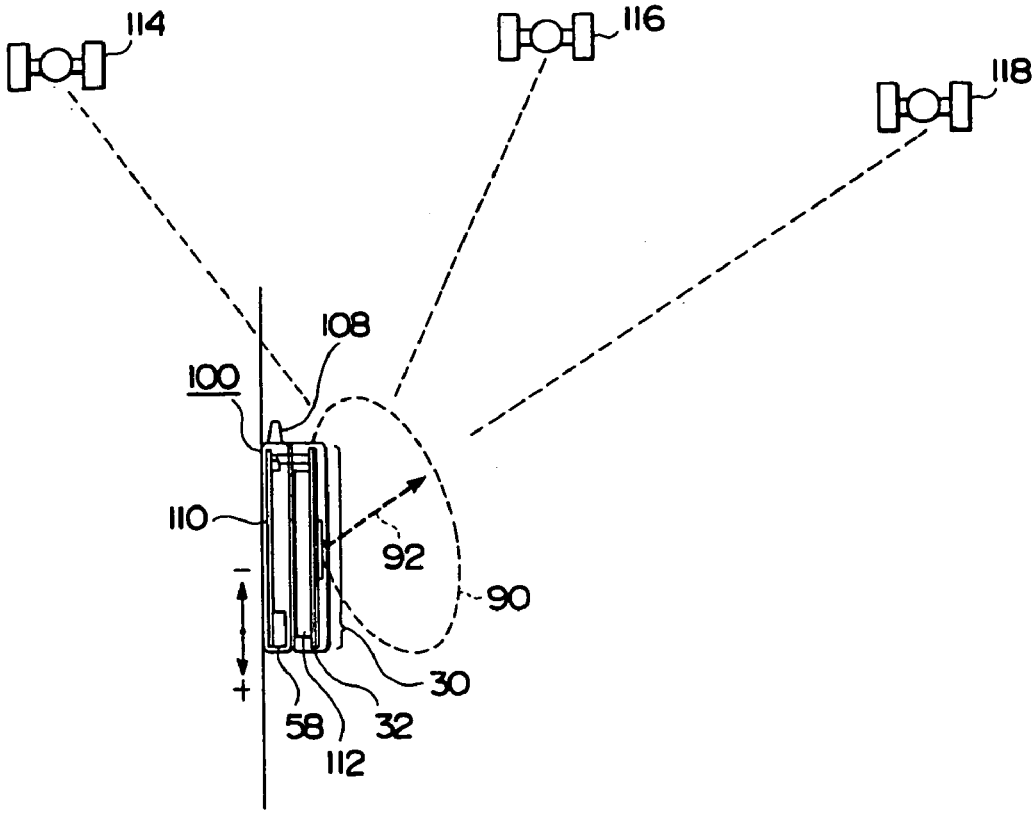
FIG. 16 is a view showing the relationship between antenna directivity of the mobile terminal and GPS satellites.
Figure 17:
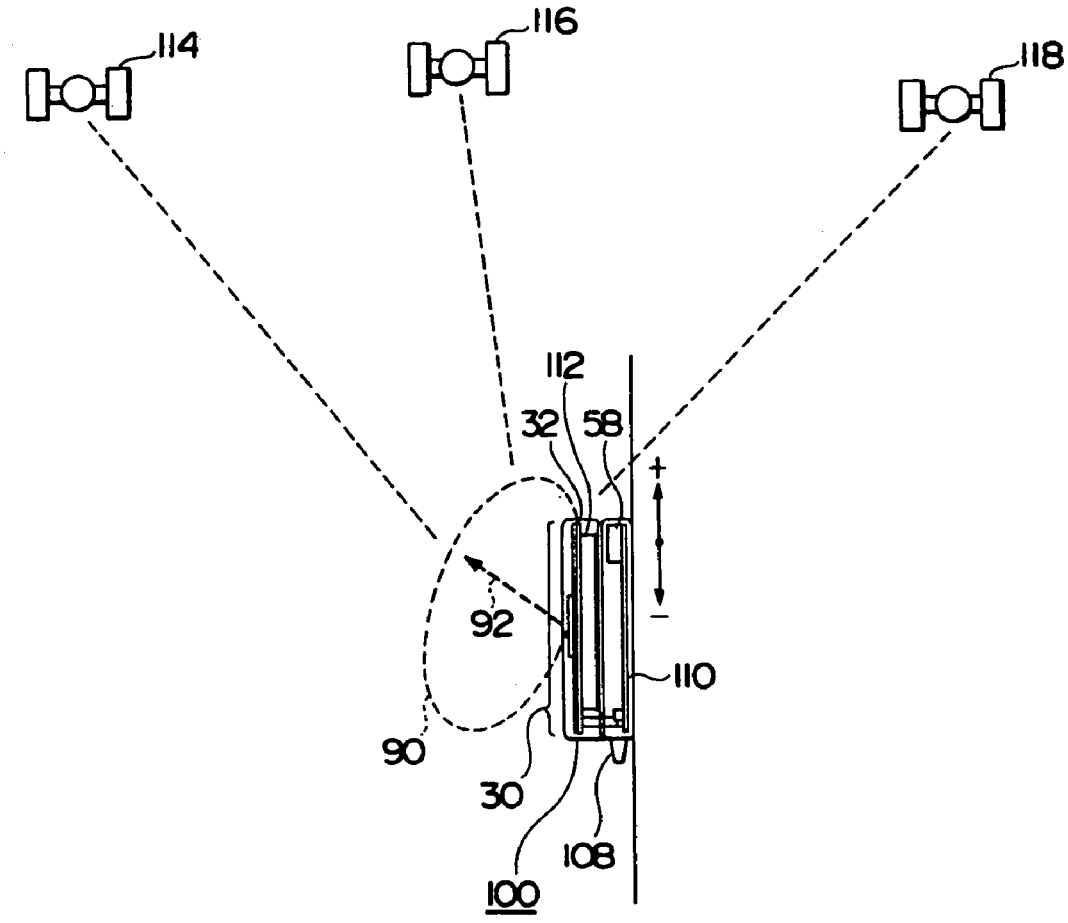
FIG. 17 is a view showing the relationship between antenna directivity of the mobile terminal and GPS satellites.

Thus, the antenna radiation pattern 90 tilts to the zenith direction no matter in which of the two upright directions the mobile terminal 100 is maintained (FIGS. 14 and 15), thus allowing the directivity thereof to point upward. This provides excellent GPS radio wave reception from GPS satellites 114, 116 and 118 located in the zenith direction as shown in FIGS. 16 and 17, improving its sensitivity and enhancing positioning accuracy.

Third Embodiment

Figure 18:
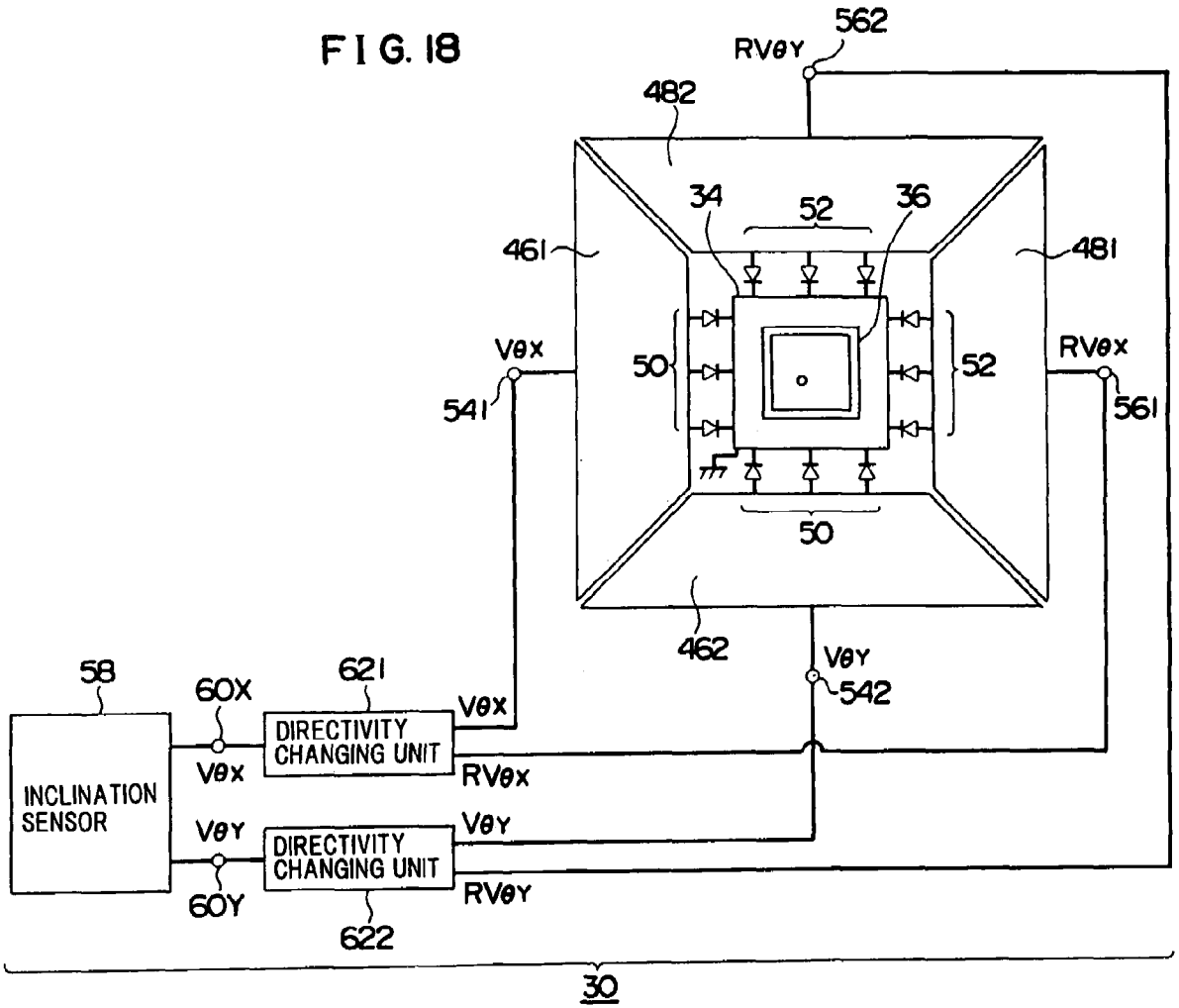
FIG. 18 is a view showing an antenna device according to a third embodiment of the present invention.

A third embodiment of the present invention will be described with reference to FIG. 18. FIG. 18 shows an antenna device according to the third embodiment of the present invention.

The antenna device 30 according to the third embodiment has the square GND pattern portion 34, for example, at its center, with auxiliary GND pattern portions 461 and 481 and auxiliary GND pattern portions 462 and 482 provided spanning along the individual parallel sides of the GND pattern portion 34, surrounding the GND pattern portion 34 with the auxiliary GND pattern portions 461, 462, 481 and 482. Each of the auxiliary GND pattern portions 461, 462, 481 and 482 is trapezoidal with a shorter inner side and a longer outer side, thus arranging these portions adjacent to each other. The auxiliary GND pattern portions 461, 462, 481 and 482 and the GND pattern portion 34 are connected together via the PIN diodes 50 and 52 as described earlier (FIG. 3), with the GND pattern portion 34 grounded. There is applied the output signal Vθx of a directivity changing unit 621 to a control terminal 541 of the auxiliary GND pattern portion 461, whereas there is applied an output signal RVθx of the directivity changing unit 621 to a control terminal 561 of the auxiliary GND pattern portion 481. Similarly, there is applied the output signal Vθy of a directivity changing unit 622 to a control terminal 542 of the auxiliary GND pattern portion 462, whereas there is applied an output signal RVθy of the directivity changing unit 622 to a control terminal 562 of the auxiliary GND pattern portion 481. Here, the output signal RVθy is an inverted signal of the output signal Vθy.

From the inclination sensor 58, the output signals Vθx and Vθy are extracted as the output signal Vθ in the directions of the X and Y axes respectively from the output terminal 60X on the X axis side and the output terminal 60Y on the Y axis side as described earlier (FIGS. 4 and 5), with the output signal Vθx applied to the directivity changing unit 621 and the output signal Vθy applied to the directivity changing unit 622. As a result, there are formed the output signal Vθx as control output and the output signal RVθx, an inverted signal of the output signal Vθx, in the directivity changing unit 621, whereas there are formed the output signal Vθy as control output and the output signal RVθy, an inverted signal of the output signal Vθy, in the directivity changing unit 622.

Such a configuration allows selective conduction and non-conduction of the PIN diodes 50 and 52, using the output signals Vθx, RVθx, Vθy and RVθy based on detection of the inclination angle θ of the inclination sensor 58 in the directions of the X and Y axes, adding the auxiliary GND pattern portion 461 and 481 to the GND pattern portion 34 or canceling the addition thereof and adding the auxiliary GND pattern portion 462 and 482 to the GND pattern portion 34 or canceling the addition thereof. This makes it possible to vary directivity of the antenna device 30 alone depending on the inclination angle θ without changing the resonance frequency of the planar antenna 36. In this embodiment, it is possible to change directivity in the X and Y directions such as directions of east, west, south and north relative to the vertical axis of the planar antenna 36 at the center. The directivity changing operation—the operation in which directivity is changed by varying the grounded conductor area of the planar antenna 36 and unevenly distributing the grounded conductor—is carried out as described earlier.

Fourth Embodiment

Figure 19:
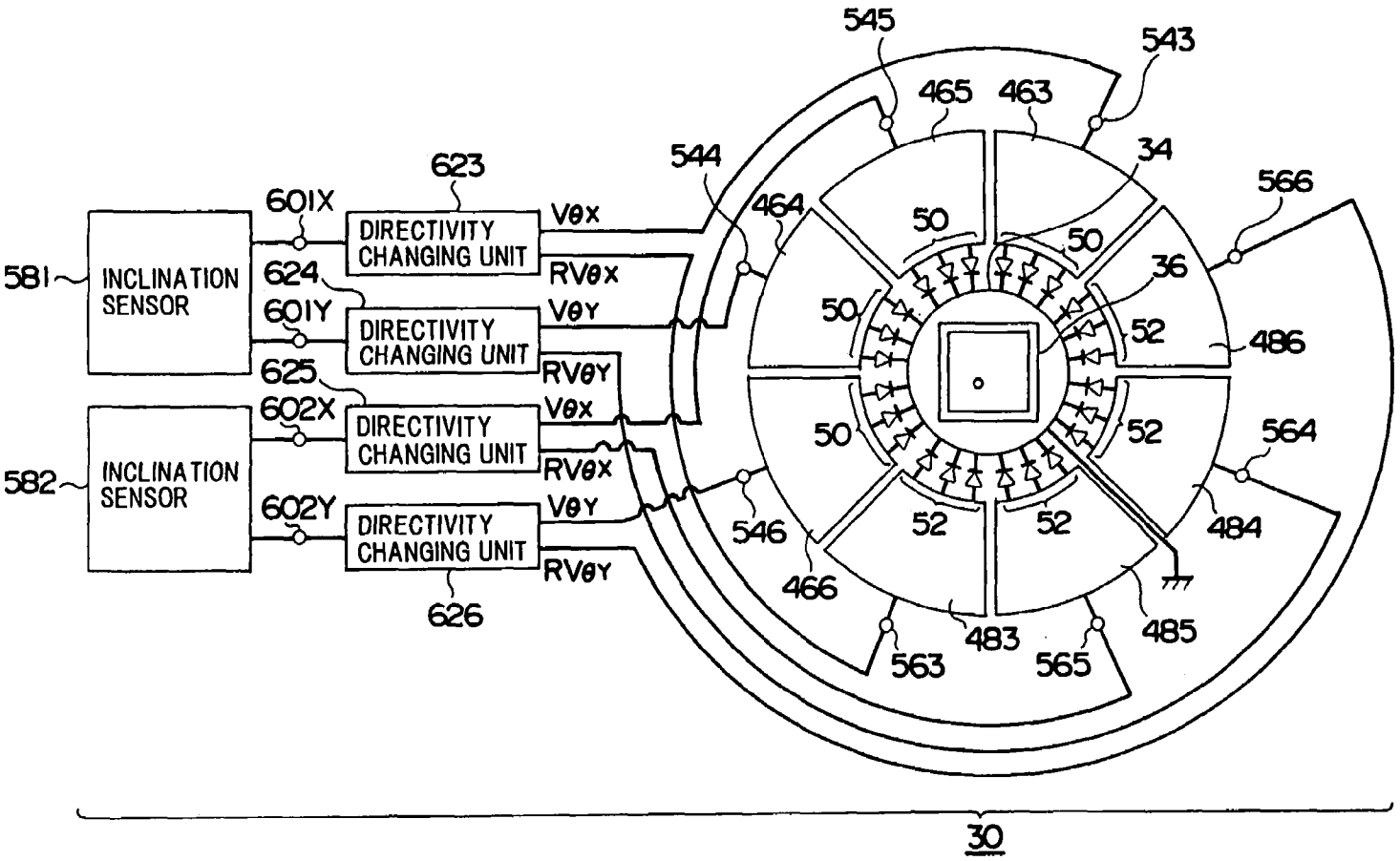
FIG. 19 is a view showing an antenna device according to a fourth embodiment of the present invention.

A fourth embodiment of the present invention will be described with reference to FIG. 19. FIG. 19 shows an antenna device according to the fourth embodiment of the present invention.

The antenna device 30 according to the fourth embodiment has the circular GND pattern portion 34, for example, at its center, with auxiliary GND pattern portions 463 and 483, auxiliary GND pattern portions 464 and 484, auxiliary GND pattern portions 465 and 485 and auxiliary GND pattern portions 466 and 486 provided spanning along the diameter of the GND pattern portion 34, shaping the auxiliary GND pattern portions 463, 464, 465, 466, 483, 484, 485 and 486 in the form of a fan so as to render them concentric with the GND pattern portion 34 and surrounding the GND pattern portion 34. The auxiliary GND pattern portions 463, 464, 465, 466, 483, 484, 485 and 486 and the GND pattern portion 34 are connected together via the PIN diodes 50 and 52 as described earlier (FIG. 3), with the GND pattern portion 34 grounded. There is applied the output signal Vθx of a directivity changing unit 623 to a control terminal 543 of the auxiliary GND pattern portion 463, whereas there is applied the output signal RVθx of the directivity changing unit 623 to a control terminal 563 of the auxiliary GND pattern portion 483. There is applied the output signal Vθy of a directivity changing unit 624 to a control terminal 544 of the auxiliary GND pattern portion 464, whereas there is applied the output signal RVθy of the directivity changing unit 624 to a control terminal 564 of the auxiliary GND pattern portion 484. Here, the output signal RVθy is an inverted signal of the output signal Vθy. There is applied the output signal Vθx of a directivity changing unit 625 to a control terminal 545 of the auxiliary GND pattern portion 465, whereas there is applied the output signal RVθx of the directivity changing unit 625 to a control terminal 565 of the auxiliary GND pattern portion 485. There is applied the output signal Vθy of a directivity changing unit 626 to a control terminal 546 of the auxiliary GND pattern portion 466, whereas there is applied the output signal RVθy of the directivity changing unit 626 to a control terminal 566 of the auxiliary GND pattern portion 486.

The inclination sensor 58, from which the output signals Vθx and Vθy in the directions of the X and Y axes can be obtained, is used as inclination sensors 581 and 582. In the case of the inclination sensor 581, the output signals Vθx and Vθy are extracted respectively from an output terminal 601X on the X axis side and an output terminal 601Y on the Y axis side, applying the output signals Vθx and Vθy respectively to the directivity changing units 623 and 624. In the case of the inclination sensor 582, the output signals Vθx and Vθy are extracted respectively from an output terminal 602X on the X axis side and an output terminal 602Y on the Y axis side, applying the output signals Vθx and Vθy respectively to the directivity changing units 625 and 626. As a result, there are formed the output signal Vθx as control output and the output signal RVθx, an inverted signal of the output signal Vθx, in the directivity changing units 623 and 625, whereas there are formed the output signal Vθy as control output and the output signal RVθy, an inverted signal of the output signal Vθy, in the directivity changing units 624 and 626. In this case, it suffices to arrange the inclination sensors 581 and 582 with a displacement, for example, of 45° in horizontal angle by associating the detected inclination angle θ with the angles of the subdivided auxiliary GND pattern portions 463, 464, 465, 466, 483, 484, 485 and 486 such that directivity appropriate to the inclination angle θ is set.

Such a configuration allows selective conduction and non-conduction of the PIN diodes 50 and 52 of the auxiliary GND pattern portions 463, 464, 465, 466, 483, 484, 485 and 486, using the output signals Vθx, RVθx, Vθy and RVθy based on detection of the inclination angle θ of the inclination sensors 581 and 582 in the directions of the X and Y axes, adding the auxiliary GND pattern portion 463 and 483 to the GND pattern portion 34 or canceling the addition thereof, adding the auxiliary GND pattern portion 464 and 484 to the GND pattern portion 34 or canceling the addition thereof, adding the auxiliary GND pattern portion 465 and 485 to the GND pattern portion 34 or canceling the addition thereof and adding the auxiliary GND pattern portion 466 and 486 to the GND pattern portion 34 or canceling the addition thereof. This makes it possible to vary directivity of the antenna device 30 alone depending on the inclination angle θ without changing the resonance frequency of the planar antenna 36. In this embodiment, it is possible to change directivity in the X and Y directions such as eight azimuths in addition to east, west, south and north relative to the vertical axis of the planar antenna 36 at the center. The directivity changing operation—the operation in which directivity is changed by varying the grounded conductor area of the planar antenna 36 and unevenly distributing the grounded conductor—is carried out as described earlier.

Such a configuration renders the detecting direction of the inclination angle θ two-dimensional, thus allowing two-dimensional directivity change. Through improved detecting resolution allowing detection of the small inclination angle θ, it is possible to provide elaborate directivity control, thus improving positioning accuracy.

Fifth Embodiment

Figure 20:
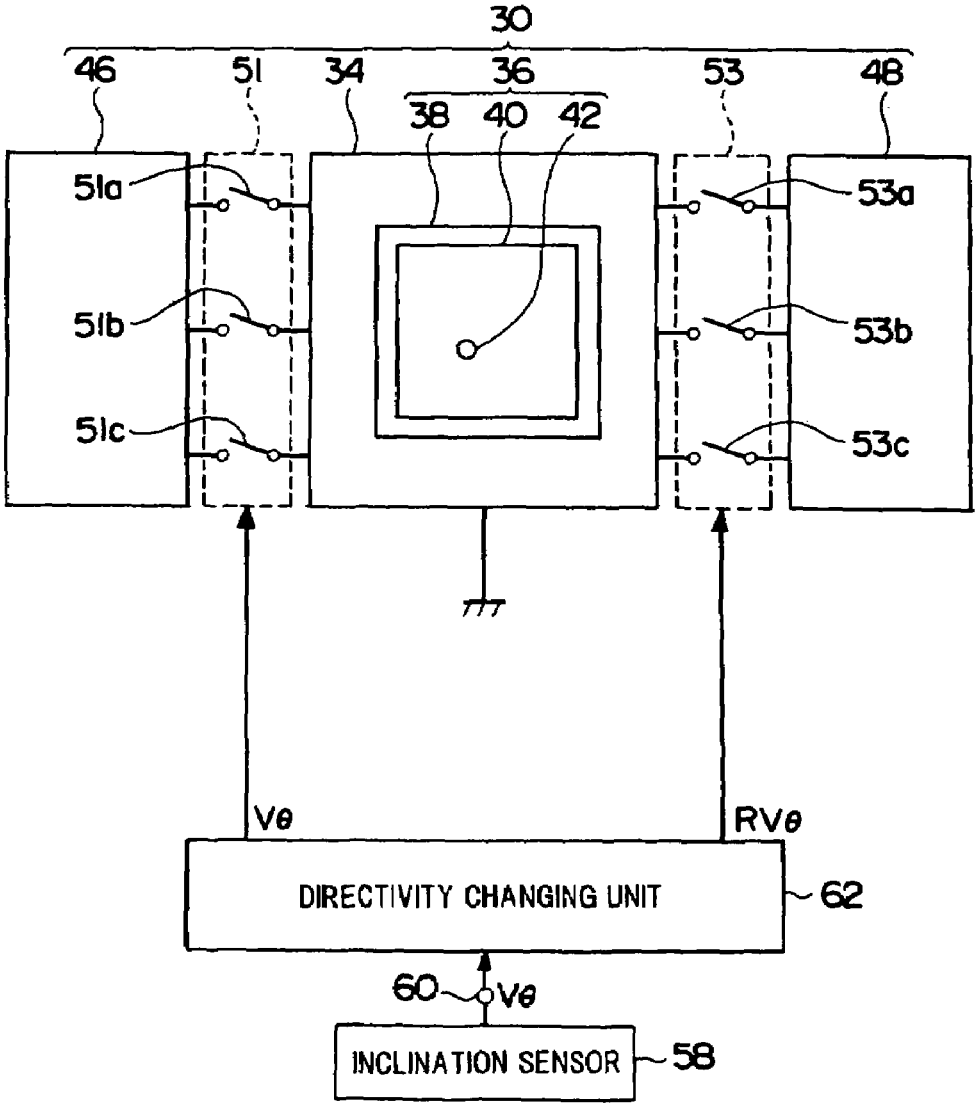
FIG. 20 is a view showing an antenna device according to a fifth embodiment of the present invention.
Figure 21:
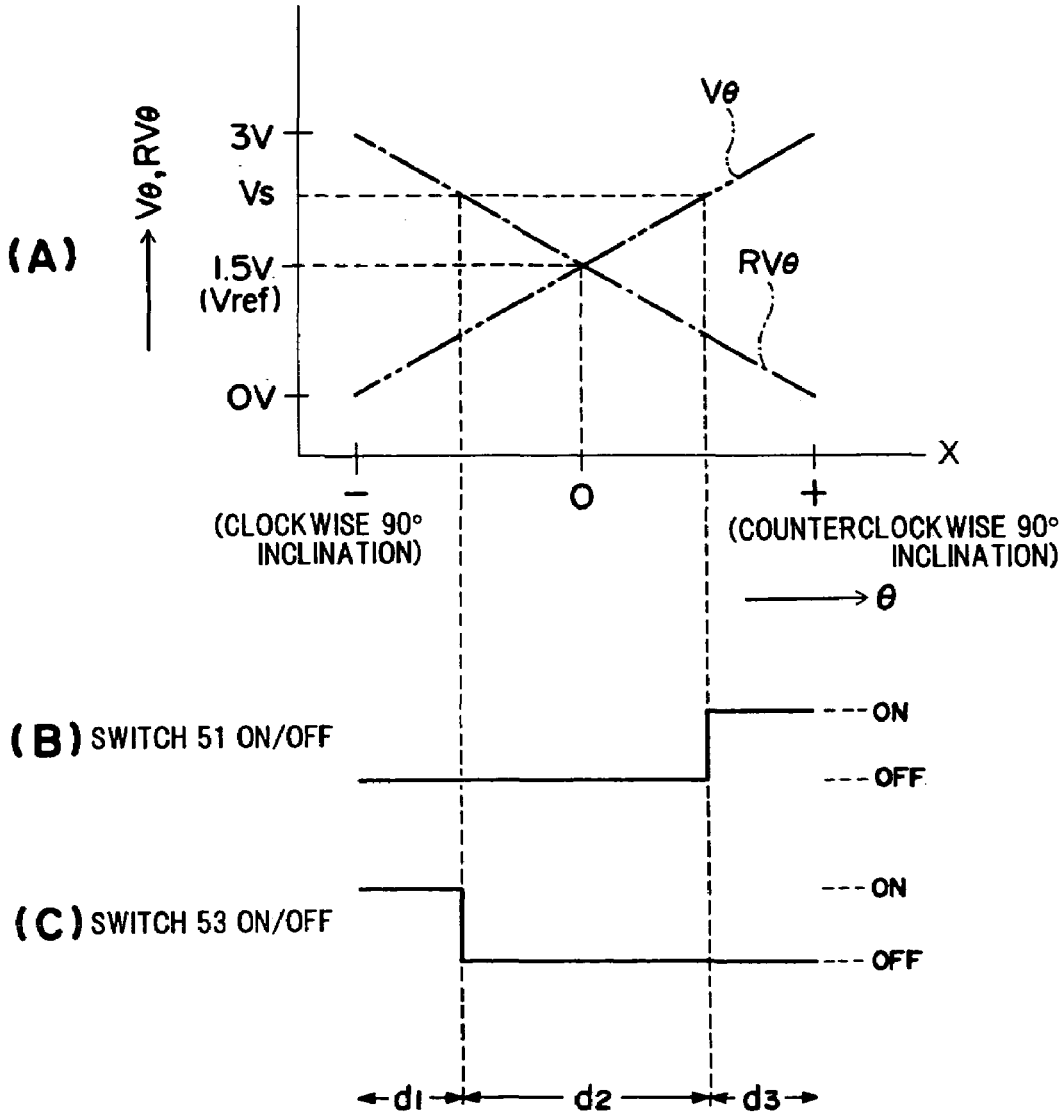
FIG. 21 is a view showing a directivity changing operation of the antenna device.

A fifth embodiment of the present invention will be described with reference to FIGS. 20 and 21. FIG. 20 shows an antenna device according to the fifth embodiment of the present invention, whereas FIG. 21 shows the directivity changing operation thereof. The same symbols are assigned to parts identical to those of the first embodiment.

The antenna device 30 according to this embodiment is configured by switches 51 and 53 as changing portions in place of the PIN diodes 50 and 52 in the first to fourth embodiments. The switches 51 and 53 are made up of switches 51*a*, 51*b* and 51*c* and switches 53*a*, 53*b* and 53*c*, respectively.

The output signal Vθ—a signal extracted from the output terminal 60 of the inclination sensor 58 for detecting the inclination angle θ of the planar antenna 36—is applied to the directivity changing unit 62 as directivity changing information. The directivity changing unit 62 in this embodiment differs from that in the first embodiment in that the switch 51 or 53 conducts when the inclination angle θ goes out of a given range, adding the auxiliary GND pattern portion 46 or 48 to the GND pattern portion 34 depending on the angular direction.

In such a configuration, the output signal Vθ and the output signal RVθ, an inverted signal of the signal Vθ, are obtained in the directivity changing unit 62 in response to the output signal Vθ of the inclination sensor 58 as shown in FIG. 21(A), making the output signals Vθ and RVθ invertedly related with each other relative to the reference voltage $V_{ref}$ at the center. The specific relationship between output voltage of the output signal Vθ of the inclination sensor 58 and detected angle is omitted as it is as described earlier.

Therefore, if the inclination angle θ of the inclination sensor 58 is displaced from the clockwise 90° position to the counterclockwise 90° position, the output signal Vθ of the inclination sensor 58 gradually increases from 0 [V]. When the output signal Vθ exceeds a given voltage $V_S$ ($V\theta \geqq V_S$), the switch 51 conducts, adding the auxiliary GND pattern portion 46 to the GND pattern portion 34. This addition period is the conduction interval $d_3$ of the switch 51 shown in FIG. 21(B).

If the inclination angle θ of the inclination sensor 58 is displaced from the counterclockwise 90° position to the clockwise 90° position, the output signal Vθ of the inclination sensor 58 gradually decreases from 3 [V]. The output signal RVθ obtained at the directivity changing unit 62 gradually increases from 0 [V]. When the output signal RVθ exceeds the given voltage $V_S$ ($RV\theta \geqq V_S$), the switch 53 conducts, adding the auxiliary GND pattern portion 48 to the GND pattern portion 34. This addition period is the conduction interval $d_1$, of the switch 53 shown in FIG. 21(C).

As a result, the grounded conductors change in the conduction intervals $d_1$, $d_2$ and $d_3$ as follows.

Conduction interval $d_1$, (conduction of the switch 53): GND pattern portion 34+auxiliary GND pattern portion 48=grounded conductor 94 (FIG. 12)

Conduction interval $d_2$ (non-conduction of both the switches 51 and 53): GND pattern portion 34 only Conduction interval $d_3$ (conduction of the switch 51): GND pattern portion 34+auxiliary GND pattern portion 46=grounded conductor 88 (FIG. 10)

In the conduction interval $d_1$ in which the switch 53 conducts, the auxiliary GND pattern portion 48 is added to the GND pattern portion 34 by the conducting switch 53 as shown in FIG. 12, leaving the auxiliary GND pattern portion 46 unfunctional as a grounded conductor. As a result, the grounded conductor 94 is unevenly distributed because of combining of the GND pattern portion 34 and the auxiliary GND pattern portion 48, tilting the antenna radiation pattern 90 of the planar antenna 36 toward the side of the auxiliary GND pattern portion 48 as shown in FIG. 13 and resulting in tilted directivity as shown by the arrow 92.

In the conduction interval $d_3$ in which only the switch 51 conducts, the auxiliary GND pattern portion 46 is added to the GND pattern portion 34 by the conducting switch 51 as shown in FIG. 10, leaving the auxiliary GND pattern portion 48 unfunctional as a grounded conductor. As a result, the grounded conductor 88 is unevenly distributed because of combining of the GND pattern portion 34 and the auxiliary GND pattern portion 46, tilting the antenna radiation pattern 90 of the planar antenna 36 toward the side of the auxiliary GND pattern portion 46 as shown in FIG. 11 and resulting in tilted directivity as shown by the arrow 92.

According to this embodiment, when the inclination angle θ of the planar antenna 36 goes out of a given range, the auxiliary GND pattern portion 46 or 48 is added to the GND pattern portion 34 or the addition thereof is canceled depending on the inclination angle θ, changing directivity of the planar antenna 36. As described earlier, directivity is changed through uneven distribution of the grounded conductors' area alone, thus keeping resonance frequency unchanged as a result of changed directivity. Using the antenna device 30 in a communications apparatus, it is possible to point directivity toward the radio wave arrival direction or the optimal radiation direction, enhancing communications reliability and improving reception sensitivity. Therefore, using the antenna device 30 for GPS radio wave reception ensures enhanced positioning accuracy through improved reception sensitivity.

Sixth Embodiment

Figure 22:
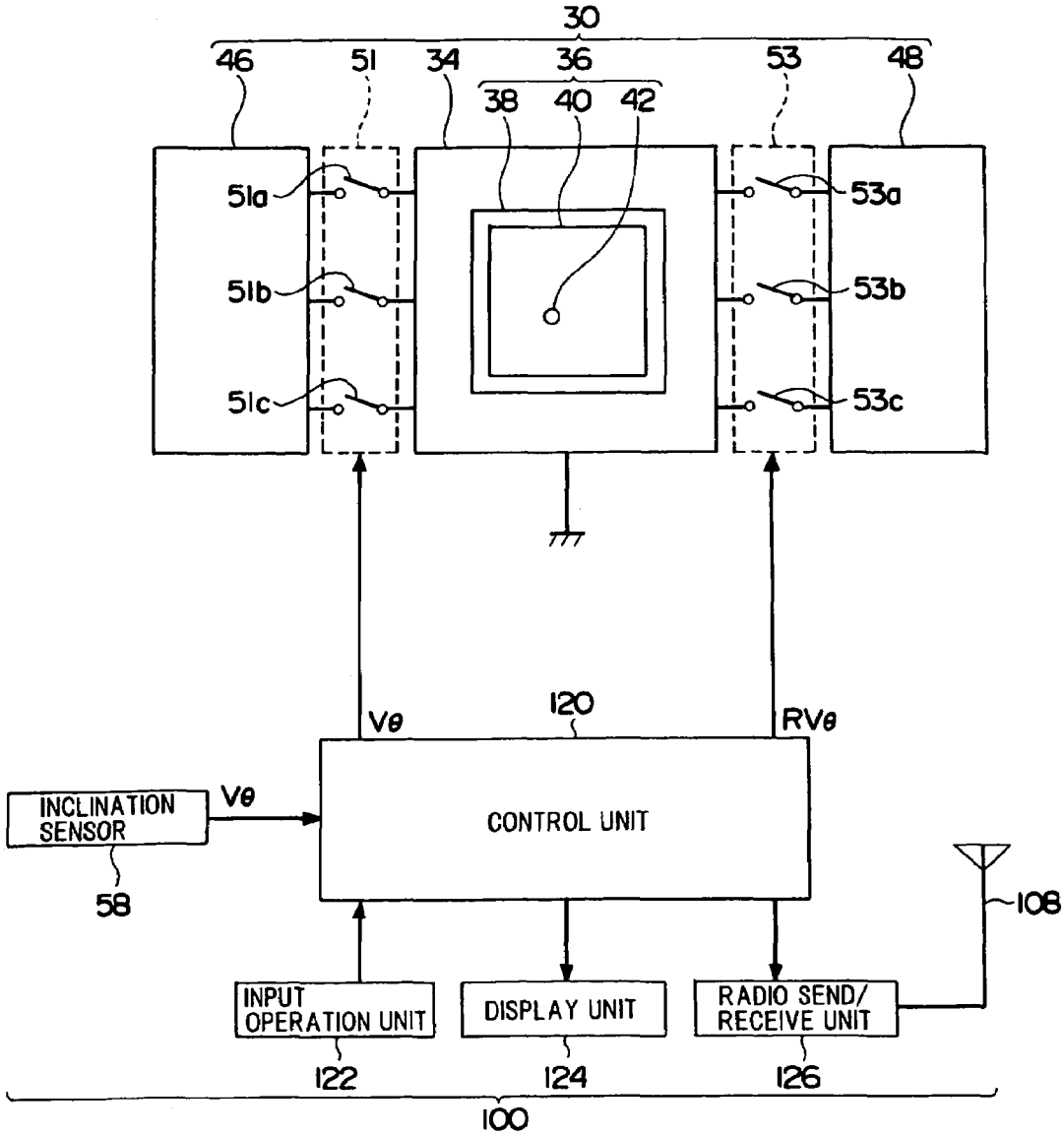
FIG. 22 is a view showing a mobile terminal according to a sixth embodiment of the present invention.
Figure 23:
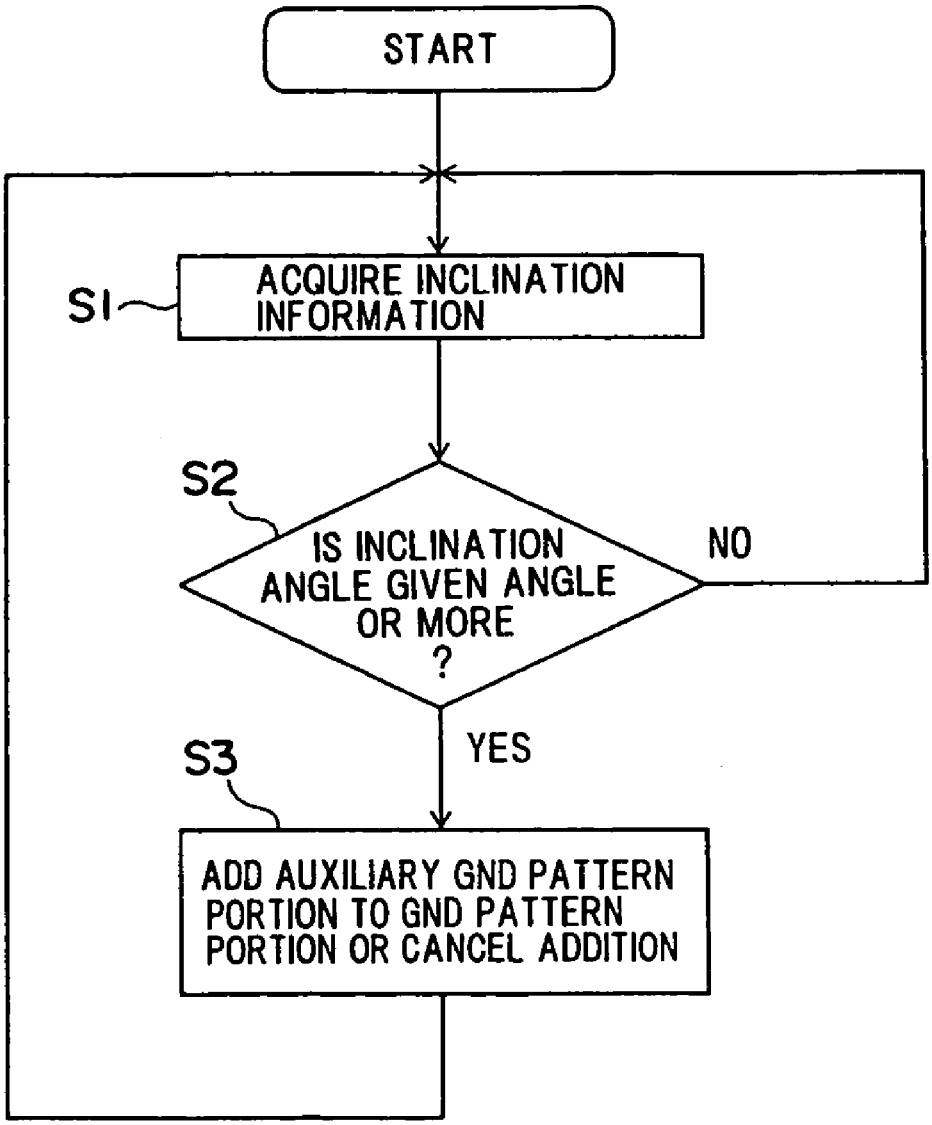
FIG. 23 is a flowchart showing a directivity control method or control program.

A sixth embodiment of the present invention will be described with reference to FIGS. 22 and 23. FIG. 22 shows a mobile terminal according to the sixth embodiment of the present invention, whereas FIG. 23 shows a directivity control method or program. In FIG. 22, the same symbols are assigned to parts identical to those of the first or fifth embodiment.

The mobile terminal 100 makes up a communications apparatus equipped with mobile phone and GPS capabilities. While there is provided the antenna device 30 described in the fifth embodiment in the mobile terminal 100, a control unit 120 is provided that is equipped with the capability of the directivity changing unit 62 (FIG. 20) of the antenna device 30. The control unit 120 is configured as an information processing unit for implementing the mobile phone capability, with the output signal Vθ of the inclination sensor 58, an input operation unit 122 mounted on the enclosure of the mobile terminal 100, a display unit 124 as an information presentation unit for presenting various information in a visual manner, a radio send/receive unit 126 for handling phone communication through the communications antenna 108, etc. connected to the control unit 120. Although not shown, a microphone, speaker and so on are connected to the control unit 120 for transmission and reception.

Such a configuration allows detection of the inclination angle θ occurring on the planar antenna 36 by the inclination sensor 58 because of mounting geometry of the mobile terminal 100, allowing the output signal Vθ, a signal representing the inclination angle θ, to be loaded into the control unit 120 as control information. The output signal Vθ and the output signal RVθ, an inverted signal of the signal Vθ, are obtained in the control unit 120, opening or closing the switches 51 and 53. As a result, the auxiliary GND pattern portion 46 or 48 is added to the GND pattern portion 34 or the addition thereof is canceled depending on the inclination angle θ, changing directivity of the planar antenna 36.

Describing this directivity change with reference to a flowchart in FIG. 23 showing the processings of the control unit 120, acquisition of inclination information is performed (Step S1), loading the output signal Vθ of the inclination sensor 58 in this acquisition. The inclination angle in the loaded inclination information is judged to determine whether it is greater than a given angle θr or not (Step S2). The process returns to Step S1 if the inclination angle is within the given angle range. In this case, directivity change is not needed as reception sensitivity remains unaffected as long as the inclination is not equal to or greater than the given angle.

When the inclination angle θ is equal to or greater than the given angle, the grounded conductors are changed. The auxiliary GND pattern portion 46 or 48 is added to the GND pattern portion 34 or the addition thereof is canceled (Step S3). This tilts directivity toward the direction of uneven distribution of the grounded conductors, changing directivity toward the radio wave arrival direction and enhancing reception sensitivity. It is also possible to point electric field strength toward the optimal direction during radio wave radiation, thus enhancing transmission strength to a communications apparatus on the other end.

Seventh Embodiment

Figure 24:
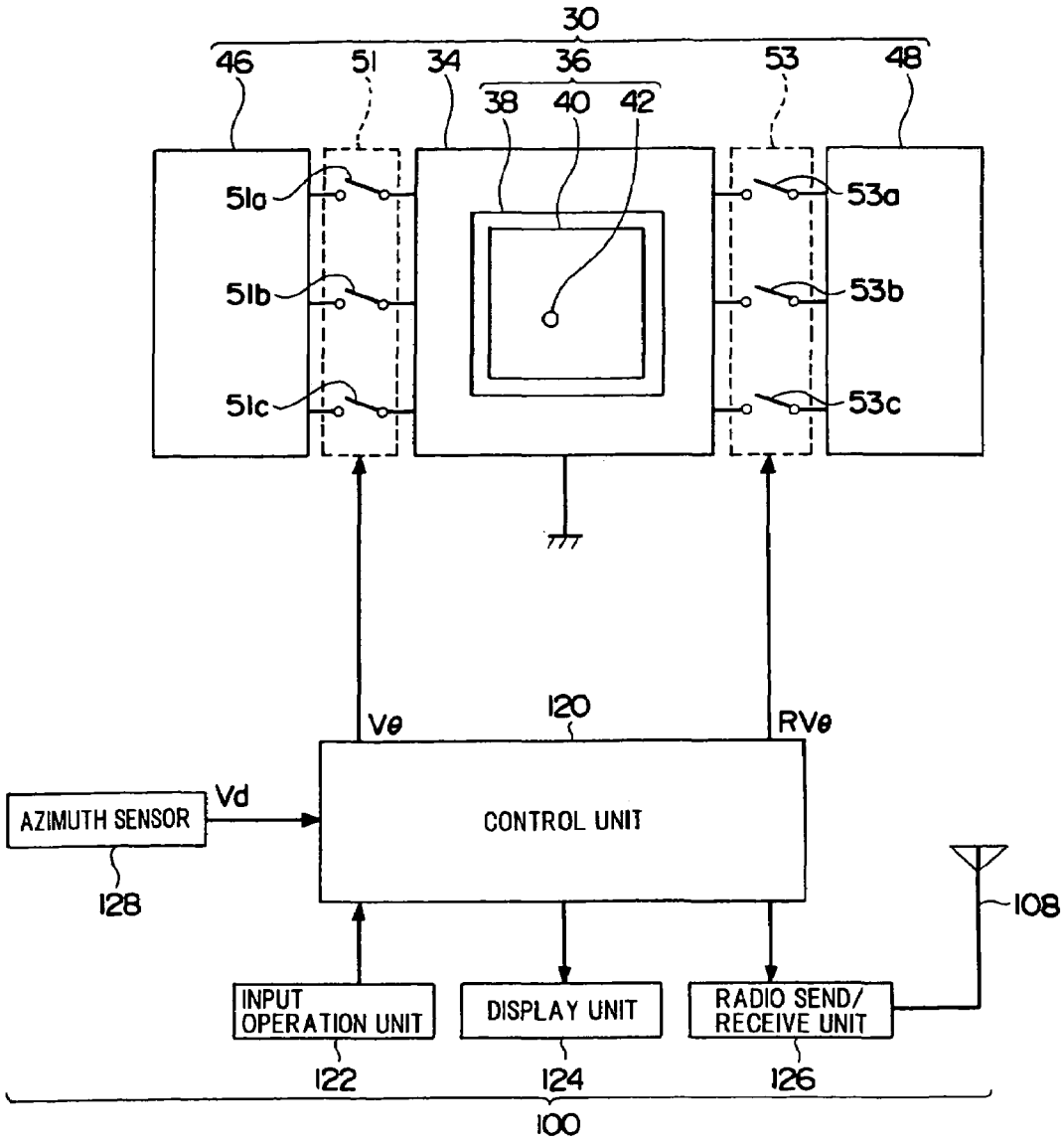
FIG. 24 is a view showing a mobile terminal according to a seventh embodiment of the present invention.
Figure 25:
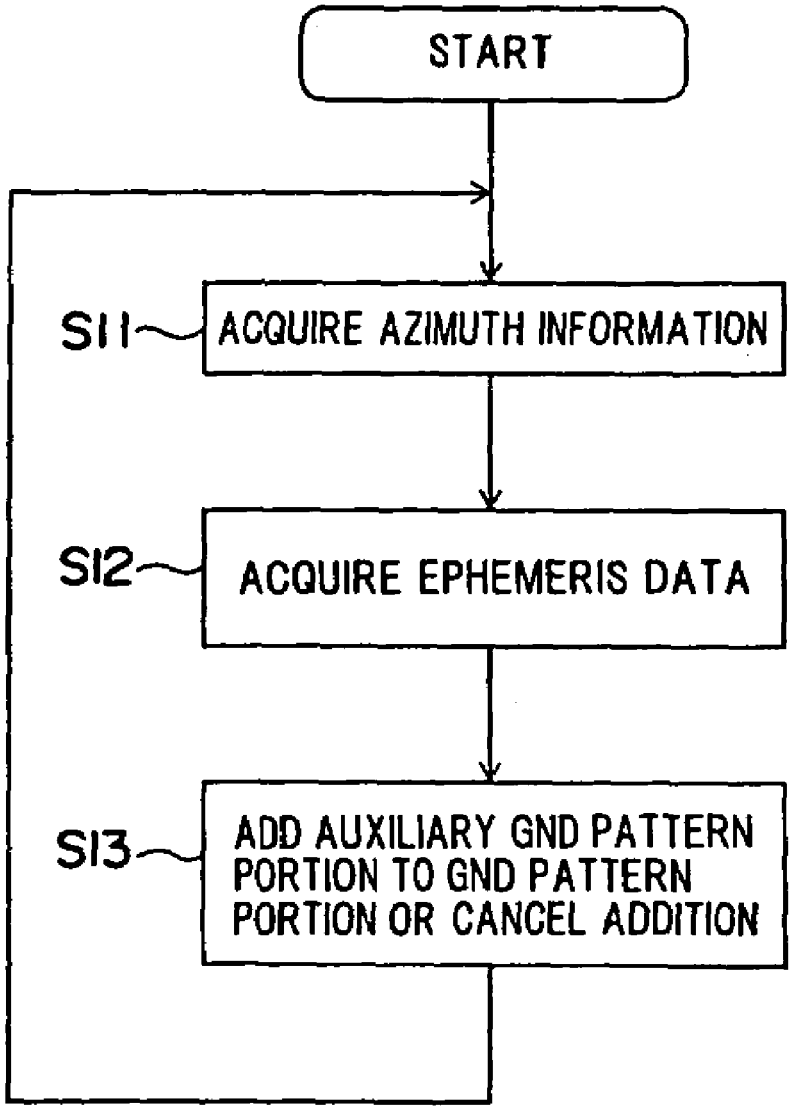
FIG. 25 is a flowchart showing a directivity control method or control program.

A seventh embodiment of the present invention will be described with reference to FIGS. 24 and 25. FIG. 24 shows a mobile terminal according to the seventh embodiment of the present invention, whereas FIG. 25 shows a directivity control method or program. In FIG. 24, the same symbols are assigned to parts identical to those of the sixth embodiment.

In this embodiment, an azimuth sensor 128 is provided as an azimuth detection unit, thus feeding an azimuth signal Vd to the control unit 120 as input for use as directivity change information. The other portions of the configuration are the same as in the sixth embodiment.

Such a configuration allows recognition of the direction of the mobile terminal 100 itself as a result of the azimuth sensor 128 provided in the mobile terminal 100, thus making it possible to control directivity to point toward the direction of the satellite needed for positioning using ephemeris data as directivity change information during GPS measurement. This configuration also provides enhanced reception strength of incoming GPS radio wave and improved reception sensitivity for improved positioning accuracy.

Describing this directivity change with reference to a flowchart in FIG. 25 showing the processings of the control unit 120, azimuth information, a detection output of the azimuth sensor 128, is acquired (Step S11). In this case, the azimuth signal Vd of the azimuth sensor 128 is loaded into the control unit 120. GPS radio wave from satellite is received in this condition, loading ephemeris data that represents in which direction GPS satellite exists during GPS positioning (Step S12). The inclination angle θ is judged with reference to ephemeris data as azimuth information, thus changing the grounded conductor based on the result of judgment (Step S13).

As described above, the auxiliary GND pattern portion 46 or 48 is added to the GND pattern portion 34 or the addition thereof is canceled depending on the inclination angle θ and direction thereof. This tilts directivity toward the direction of uneven distribution of the grounded conductors, changing directivity toward the radio wave arrival direction and enhancing reception sensitivity for enhanced positioning accuracy. Such a configuration allows automatic changing of antenna directivity toward the direction where GPS satellite exists irrespective of the usage condition including putting the mobile terminal equipped with GPS capability in a bag, thus ensuring enhanced reception sensitivity and improved positioning accuracy.

Features and modifications of the above embodiments will be listed hereinbelow.

(1) Although, in the first, second, third and fourth embodiments, addition of the auxiliary GND pattern portion 46 or 48 to the GND pattern portion 34 is normal when the inclination angle θ is within the given angle, with the addition of the auxiliary GND pattern portion 46 or 48 on the opposite side to the inclination angle θ canceled if the inclination angle θ exceeds the given angle, the GND pattern portion 34 with not addition may be normal when the inclination angle θ is within the given angle in the first to fourth embodiments as in the fifth embodiment with the auxiliary GND pattern portion 46 or 48 in the direction of the inclination angle θ added if the inclination angle θ exceeds the given angle.

(2)Although, in the fifth embodiment, it was described that the switches 51 and 53 are switched electrically by the directivity changing unit 62, the switches 51 and 53 may be configured with relay contacts or mechanical switches, thus allowing the user to select directivity to point in a desired direction through manual switching of the switches.

(3) Although, in the above embodiments, the mobile terminal 100, etc. was illustrated as communications apparatus, information processing terminal such as personal computer, PHS (Personal Handyphone System) and PDA (Personal Data Assistant) GPS receiving device and radio receiver may be used as the antenna device and communications apparatus of the present invention, and the present invention is not limited to the embodiments.

(4) Although, in the first to fourth embodiments, diodes are used in the changing unit, transistors may be used to add or cancel addition of the grounded conductors.

(5) Although, in the first to third embodiments, the output signal Vθx is used that represents the inclination angle θ on the X axis side of the inclination sensor 58, directivity may be changed using the output signal Vθy representing the inclination angle θ on the Y axis side of the inclination sensor 58.

(6) Although, in the above embodiments, a case was described in relation to the output voltages Vθ, Vθx and Vθy in response to the inclination angle θ of the inclination sensor 58 in which the minimum voltage is obtained where the inclination angle is 90° clockwise and the maximum voltage is obtained where the inclination angle is 90° counterclockwise as shown in FIGS. 8, 9 and 21, the maximum voltage may be obtained where the inclination angle is 90° clockwise and the minimum voltage may be obtained where the inclination angle is 90° counterclockwise. The minimum, intermediate and maximum voltages of 0, 1.5 and 3 [V], shown in the embodiments, are an example, and other voltages may be used.

As set forth hereinabove, the most preferred embodiments of the present invention have been described, but the present invention is not limited to the aforementioned description. It is a matter of course that various modifications or changes thereof can be made by those skilled in the art without departing from the spirit of the invention as defined in the appended claims or disclosed in the detailed description of the invention, and it is needless to say that the present invention encompasses such modifications or changes.

The entire disclosure of Japanese Patent Application No. 2004-069516 including specification, claims, drawings and summary are incorporated herein by reference in its entirety.

What is claimed is:

1. An antenna device comprising:

a first grounded conductor;

an antenna element mounted on the first grounded conductor via an insulator;

a plurality of second grounded conductors disposed separate from the first grounded conductor;

an inclination detection unit which detects an inclination of the antenna element; and a changing unit which changes directivity of the antenna element by adding at least one of the plurality of second grounded conductors to the first grounded conductor or canceling the addition thereof depending on the inclination detected by the inclination detection unit.

2. The antenna device of claim 1, further comprising a printed board, the printed board having the plurality of second grounded conductors arranged thereon together with the first grounded conductor.

3. A directivity control method for an antenna device, comprising the steps of:

loading inclination information of an antenna element; and changing directivity of the antenna element by adding a second grounded conductor to a first grounded conductor juxtaposed to the antenna element or canceling the addition thereof depending on the loaded inclination information.

4. A directivity control program for an antenna device, the program causing an information processing unit disposed adjacent to an antenna device to execute the steps of:

loading inclination information of an antenna element; and changing directivity of the antenna element by adding a second grounded conductor to a first grounded conductor juxtaposed to the antenna element or canceling the addition thereof depending on the loaded inclination information.

5. A communications apparatus comprising:

a first grounded conductor;

an antenna element mounted on the first grounded conductor via an insulator;

a plurality of second grounded conductors disposed separate from the first grounded conductor;

an inclination detection unit which detects an inclination of the antenna element; and a changing unit which changes directivity of the antenna element by adding at least one of the plurality of second grounded conductors to the first grounded conductor or canceling the addition thereof depending on the inclination detected by the inclination detection unit.

6. The communications apparatus of claim 5, further comprising a printed board, the printed board having the plurality of second grounded conductors arranged thereon together with the first grounded conductor.

* * * * *